US011760937B2

(12) United States Patent
Quanci et al.

(10) Patent No.: US 11,760,937 B2
(45) Date of Patent: Sep. 19, 2023

(54) OVEN UPTAKES

(71) Applicant: SUNCOKE TECHNOLOGY AND DEVELOPMENT LLC, Lisle, IL (US)

(72) Inventors: John Francis Quanci, Haddonfield, NJ (US); Gary Dean West, Haddonfield, NJ (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 16/729,053

(22) Filed: Dec. 27, 2019

(65) Prior Publication Data

US 2020/0208059 A1 Jul. 2, 2020

Related U.S. Application Data

(60) Provisional application No. 62/786,027, filed on Dec. 28, 2018.

(51) Int. Cl.

| | |
|---|---|
| ***C10B 21/16*** | (2006.01) |
| ***C10B 27/06*** | (2006.01) |
| *C10B 15/02* | (2006.01) |

(52) U.S. Cl.

CPC ..... *C10B 21/16* (2013.01); *C10B 27/06* (2013.01); *C10B 15/02* (2013.01)

(58) Field of Classification Search

CPC ..... C10B 15/00; C10B 15/02; C10B 21/16; C10B 27/00; C10B 27/06; C10B 9/00;

(Continued)

(56) References Cited

U.S. PATENT DOCUMENTS

| | | | |
|---|---|---|---|
| 425,797 | A | 4/1890 | Hunt |
| 469,868 | A | 3/1892 | Osbourn |

(Continued)

FOREIGN PATENT DOCUMENTS

| | | |
|---|---|---|
| CA | 1172895 | 8/1984 |
| CA | 2775992 | 5/2011 |

(Continued)

OTHER PUBLICATIONS

English translation of DE 2720688 obtained from Espacenet.*

(Continued)

*Primary Examiner* — Jonathan Luke Pilcher
(74) *Attorney, Agent, or Firm* — Perkins Coie LLP

(57) ABSTRACT

Systems and apparatuses for controlling oven draft within a coke oven. A representative system includes an uptake damper coupled to an uptake duct that receives exhaust gases from the coke oven and provides the exhaust gases to a common tunnel for further processing. The uptake damper includes a damper plate pivotably coupled to a refractory surface of the uptake duct and an actuator assembly coupled to the damper plate. The damper plate is positioned completely within the uptake duct and the actuator assembly moves the damper plate between a plurality of different configurations by causing the damper plate to rotate relative to the uptake duct. Moving the uptake damper between the different configurations changes the flow rate and pressure of the exhaust gases through the uptake duct, which affects an oven draft within the coke oven.

19 Claims, 17 Drawing Sheets

(58) Field of Classification Search
CPC ..... F27D 2019/0031; F27B 2005/163; F23L 11/00; F23L 11/005; F23L 11/02; F23L 13/02; F23L 13/04; F23L 13/00–10
See application file for complete search history.

(56) References Cited

U.S. PATENT DOCUMENTS 705,926 A 7/1902 Hemingway
760,372 A * 5/1904 Beam ..... C10B 15/02 202/94
845,719 A 2/1907 Schniewind
875,989 A 1/1908 Garner
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,895,202 A * 1/1933 Montgomery ..... F23L 11/00 126/292
1,947,499 A 2/1934 Schrader et al.
1,955,962 A 4/1934 Jones
1,979,507 A 11/1934 Underwood
2,075,337 A 3/1937 Burnaugh
2,141,035 A 12/1938 Daniels
2,195,466 A 4/1940 Otto
2,235,970 A 3/1941 Wilputte
2,340,283 A * 1/1944 Vladu ..... F23L 13/02 126/293
2,340,981 A 2/1944 Otto
2,394,173 A 2/1946 Harris et al.
2,424,012 A 7/1947 Bangham et al.
2,486,199 A 10/1949 Nier
2,609,948 A 9/1952 Laveley
2,641,575 A 6/1953 Otto
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
2,968,083 A 1/1961 Lentz et al.
3,015,893 A 1/1962 McCreary
3,026,715 A 3/1962 Briggs
3,033,764 A 5/1962 Hannes
3,175,961 A 3/1965 Samson
3,199,135 A 8/1965 Trucker
3,224,805 A 12/1965 Clyatt
3,259,551 A 7/1966 Thompson
3,265,044 A 8/1966 Juchtern
3,267,913 A 8/1966 Jakob
3,327,521 A 6/1967 Briggs
3,342,990 A 9/1967 Barrington et al.
3,444,046 A 5/1969 Harlow
3,444,047 A 5/1969 Wilde
3,448,012 A 6/1969 Allred
3,462,345 A 8/1969 Kernan
3,511,030 A 5/1970 Brown et al.
3,542,650 A 11/1970 Kulakov
3,545,470 A 12/1970 Paton
3,587,198 A 6/1971 Hensel
3,591,827 A 7/1971 Hall
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobie et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,912,597 A 10/1975 MacDonald
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,979,870 A 9/1976 Moore
3,984,289 A 10/1976 Sustarsic et al.
3,990,948 A 11/1976 Lindgren
4,004,702 A 1/1977 Szendroi
4,004,983 A 1/1977 Pries
4,025,395 A 5/1977 Ekholm et al.
4,040,910 A 8/1977 Knappstein et al.
4,045,056 A 8/1977 Kandakov et al.
4,045,299 A 8/1977 McDonald
4,059,885 A 11/1977 Oldengott
4,065,059 A 12/1977 Jablin
4,067,462 A 1/1978 Thompson
4,077,848 A 3/1978 Grainer et al.
4,083,753 A 4/1978 Rogers et al.
4,086,231 A 4/1978 Ikio
4,093,245 A 6/1978 Connor
4,100,033 A 7/1978 Holter
4,100,491 A 7/1978 Newman, Jr. et al.
4,100,889 A 7/1978 Chayes
4,111,757 A 9/1978 Carimboli
4,124,450 A 11/1978 MacDonald
4,133,720 A 1/1979 Franzer et al.
4,135,948 A 1/1979 Mertens et al.
4,141,796 A 2/1979 Clark et al.
4,143,104 A 3/1979 van Konijnenburg et al.
4,145,195 A 3/1979 Knappstein et al.
4,147,230 A 4/1979 Ormond et al.
4,162,546 A 7/1979 Shorten et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,226,113 A 10/1980 Pelletier et al.
4,230,498 A 10/1980 Ruecki
4,235,830 A 11/1980 Bennett et al.
4,239,602 A 12/1980 La Bate
4,248,671 A 2/1981 Belding

(56) References Cited

U.S. PATENT DOCUMENTS 4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,298,497 A 11/1981 Colombo
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,316,435 A 2/1982 Nagamatsu et al.
4,324,568 A 4/1982 Wilcox et al.
4,330,372 A 5/1982 Cairns et al.
4,334,963 A 6/1982 Stog
4,336,107 A 6/1982 Irwin
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,385,962 A 5/1983 Stewen et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,518,461 A 5/1985 Gelfand
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,749,446 A 6/1988 van Laar et al.
4,793,981 A 12/1988 Doyle et al.
4,821,473 A * 4/1989 Cowell ..... F23J 11/00 126/297
4,824,614 A 4/1989 Jones et al.
4,889,698 A 12/1989 Moller et al.
4,898,021 A 2/1990 Weaver et al.
4,918,975 A 4/1990 Voss
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A * 5/1992 Childress ..... C10B 27/06 201/15
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,398,543 A 3/1995 Fukushima et al.
5,423,152 A 6/1995 Kolvek
5,447,606 A 9/1995 Pruitt
5,480,594 A 1/1996 Wilkerson et al.
5,542,650 A 8/1996 Abel et al.
5,597,452 A 1/1997 Hippe et al.
5,622,280 A 4/1997 Mays et al.
5,659,110 A 8/1997 Herden et al.
5,670,025 A 9/1997 Baird
5,687,768 A 11/1997 Albrecht et al.
5,705,037 A 1/1998 Reinke et al.
5,715,962 A 2/1998 McDonnell
5,720,855 A 2/1998 Baird
5,745,969 A 5/1998 Yamada et al.
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,881,551 A 3/1999 Dang
5,913,448 A 6/1999 Mann et al.
5,928,476 A 7/1999 Daniels
5,966,886 A 10/1999 Di Loreto
5,968,320 A 10/1999 Sprague
6,002,993 A 12/1999 Naito et al.
6,017,214 A 1/2000 Sturgulewski
6,022,112 A 2/2000 Isler et al.
6,059,932 A 5/2000 Sturgulewski
6,126,910 A 10/2000 Wilhelm et al.
6,139,692 A 10/2000 Tamura et al.
6,152,668 A 11/2000 Knoch
6,156,688 A 12/2000 Ando et al.
6,173,679 B1 1/2001 Bruckner et al.
6,187,148 B1 2/2001 Sturgulewski
6,189,819 B1 2/2001 Racine
6,290,494 B1 9/2001 Barkdoll
6,412,221 B1 7/2002 Emsbo
6,495,268 B1 12/2002 Harth, III et al.
6,539,602 B1 4/2003 Ozawa et al.
6,596,128 B2 7/2003 Westbrook
6,626,984 B1 9/2003 Taylor
6,699,035 B2 3/2004 Brooker
6,712,576 B2 3/2004 Skarzenski et al.
6,758,875 B2 7/2004 Reid et al.
6,786,941 B2 9/2004 Reeves et al.
6,830,660 B1 12/2004 Yamauchi et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,547,377 B2 6/2009 Inamasu et al.
7,611,609 B1 11/2009 Valia et al.
7,644,711 B2 1/2010 Creel

(56) References Cited

U.S. PATENT DOCUMENTS 7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,146,376 B1 4/2012 Williams et al.
8,152,970 B2 4/2012 Barkdoll et al.
8,172,930 B2 5/2012 Barkdoll
8,236,142 B2 8/2012 Westbrook
8,266,853 B2 9/2012 Bloom et al.
8,311,777 B2 11/2012 Suguira et al.
8,398,935 B2 3/2013 Howell et al.
8,409,405 B2 4/2013 Kim et al.
8,500,881 B2 8/2013 Orita et al.
8,515,508 B2 8/2013 Kawamura et al.
8,568,568 B2 10/2013 Schuecker et al.
8,640,635 B2 2/2014 Bloom et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,103,234 B2 8/2015 Gu et al.
9,193,915 B2 11/2015 West et al.
9,238,778 B2 1/2016 Quanci et al.
9,243,186 B2 1/2016 Quanci et al.
9,249,357 B2 2/2016 Quanci et al.
9,273,249 B2 3/2016 Quanci et al.
9,359,554 B2 6/2016 Quanci et al.
9,404,043 B2 8/2016 Kim
9,463,980 B2 10/2016 Fukada et al.
9,498,786 B2 11/2016 Pearson
9,580,656 B2 2/2017 Quanci et al.
9,672,499 B2 6/2017 Quanci et al.
9,708,542 B2 7/2017 Quanci et al.
9,862,888 B2 1/2018 Quanci et al.
9,976,089 B2 5/2018 Quanci et al.
10,016,714 B2 7/2018 Quanci et al.
10,041,002 B2 8/2018 Quanci et al.
10,047,295 B2 8/2018 Chun et al.
10,047,296 B2 8/2018 Chun et al.
10,053,627 B2 8/2018 Sarpen et al.
10,233,392 B2 3/2019 Quanci et al.
10,308,876 B2 6/2019 Quanci et al.
10,323,192 B2 6/2019 Quanci et al.
10,526,541 B2 1/2020 West et al.
10,578,521 B1 3/2020 Dinakaran et al.
10,732,621 B2 8/2020 Celia et al.
10,877,007 B2 12/2020 Steele et al.
1,378,782 A1 5/2021 Floyd
11,008,517 B2 5/2021 Chun et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2004/0220840 A1 11/2004 Bonissone et al.
2005/0087767 A1 4/2005 Fitzgerald et al.
2006/0029532 A1 2/2006 Breen et al.
2006/0102420 A1 5/2006 Huber et al.
2006/0149407 A1 7/2006 Markham et al.
2007/0087946 A1 4/2007 Quest et al.
2007/0102278 A1 5/2007 Inamasu et al.
2007/0116619 A1 5/2007 Taylor et al.
2007/0251198 A1 11/2007 Witter
2008/0028935 A1 2/2008 Andersson
2008/0179165 A1 7/2008 Chen et al.
2008/0250863 A1 10/2008 Moore
2008/0257236 A1 10/2008 Green
2008/0271985 A1 11/2008 Yamasaki
2008/0289305 A1 11/2008 Girondi
2009/0007785 A1 1/2009 Kimura et al.
2009/0032385 A1* 2/2009 Engle ..... F23L 13/06 202/151
2009/0152092 A1 6/2009 Kim et al.
2009/0162269 A1 6/2009 Barger et al.
2009/0217576 A1 9/2009 Kim et al.
2009/0257932 A1 10/2009 Canari et al.
2009/0283395 A1 11/2009 Hippe
2010/0015564 A1 1/2010 Chun et al.
2010/0095521 A1 4/2010 Kartal et al.
2010/0106310 A1 4/2010 Grohman
2010/0113266 A1 5/2010 Abe et al.
2010/0115912 A1 5/2010 Worley
2010/0119425 A1 5/2010 Palmer
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0300867 A1 12/2010 Kim et al.
2010/0314234 A1 12/2010 Knoch et al.
2011/0000284 A1 1/2011 Kumar et al.
2011/0014406 A1 1/2011 Coleman et al.
2011/0048917 A1 3/2011 Kim et al.
2011/0083314 A1 4/2011 Baird
2011/0088600 A1 4/2011 McRae
2011/0120852 A1 5/2011 Kim
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim
2011/0198206 A1 8/2011 Kim et al.
2011/0223088 A1 9/2011 Chang et al.
2011/0253521 A1 10/2011 Kim
2011/0291827 A1 12/2011 Baldocchi et al.
2011/0313218 A1 12/2011 Dana
2011/0315538 A1 12/2011 Kim et al.
2012/0024688 A1 2/2012 Barkdoll
2012/0030998 A1 2/2012 Barkdoll et al.
2012/0031076 A1 2/2012 Frank et al.
2012/0125709 A1 5/2012 Merchant et al.
2012/0152720 A1 6/2012 Reichelt et al.
2012/0177541 A1 7/2012 Mutsuda et al.
2012/0180133 A1 7/2012 Ai-Harbi et al.
2012/0195815 A1 8/2012 Moore et al.
2012/0228115 A1 9/2012 Westbrook
2012/0247939 A1 10/2012 Kim et al.
2012/0305380 A1 12/2012 Wang et al.
2012/0312019 A1 12/2012 Rechtman
2013/0020781 A1 1/2013 Kishikawa
2013/0045149 A1 2/2013 Miller
2013/0213114 A1 8/2013 Wetzig et al.
2013/0216717 A1 8/2013 Rago et al.
2013/0220373 A1 8/2013 Kim
2013/0306462 A1 11/2013 Kim et al.
2014/0033917 A1 2/2014 Rodgers et al.
2014/0039833 A1 2/2014 Sharpe, Jr. et al.
2014/0061018 A1 3/2014 Sarpen et al.
2014/0083836 A1 3/2014 Quanci et al.
2014/0156584 A1 6/2014 Motukuri et al.
2014/0182195 A1 7/2014 Quanci et al.
2014/0182683 A1 7/2014 Quanci et al.
2014/0183023 A1 7/2014 Quanci et al.
2014/0208997 A1 7/2014 Alferyev et al.
2014/0224123 A1 8/2014 Walters
2014/0262139 A1 9/2014 Choi et al.
2014/0262726 A1 9/2014 West et al.
2015/0122629 A1 5/2015 Freimuth et al.
2015/0143908 A1 5/2015 Cetinkaya
2015/0175433 A1 6/2015 Micka et al.
2015/0219530 A1 8/2015 Li et al.
2015/0226499 A1 8/2015 Mikkelsen
2015/0247092 A1 9/2015 Quanci et al.
2015/0361346 A1 12/2015 West et al.
2015/0361347 A1 12/2015 Ball et al.
2016/0026193 A1 1/2016 Rhodes et al.
2016/0048139 A1 2/2016 Samples et al.
2016/0149944 A1 5/2016 Obermeirer et al.
2016/0154171 A1 6/2016 Kato et al.

(56) References Cited

U.S. PATENT DOCUMENTS

| | | | |
|---|---|---|---|
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2016/0319197 | A1 | 11/2016 | Quanci et al. |
| 2016/0319198 | A1 | 11/2016 | Quanci et al. |
| 2017/0015908 | A1 | 1/2017 | Quanci et al. |
| 2017/0182447 | A1 | 6/2017 | Sappok et al. |
| 2017/0183569 | A1 | 6/2017 | Quanci et al. |
| 2017/0253803 | A1 | 9/2017 | West et al. |
| 2017/0261417 | A1 | 9/2017 | Zhang |
| 2017/0313943 | A1 | 11/2017 | Valdevies |
| 2017/0352243 | A1 | 12/2017 | Quanci et al. |
| 2018/0340122 | A1 | 11/2018 | Crum et al. |
| 2019/0099708 | A1 | 4/2019 | Quanci |
| 2019/0161682 | A1 | 5/2019 | Quanci et al. |
| 2019/0169503 | A1 | 6/2019 | Chun et al. |
| 2019/0317167 | A1 | 10/2019 | LaBorde et al. |
| 2019/0352568 | A1 | 11/2019 | Quanci et al. |
| 2020/0071190 | A1 | 3/2020 | Wiederin et al. |
| 2020/0139273 | A1 | 5/2020 | Badiei |
| 2020/0173679 | A1 | 6/2020 | O'Reilly et al. |
| 2021/0130697 | A1 | 5/2021 | Quanci et al. |
| 2021/0163821 | A1 | 6/2021 | Quanci et al. |
| 2021/0163822 | A1 | 6/2021 | Quanci et al. |
| 2021/0163823 | A1 | 6/2021 | Quanci et al. |
| 2021/0198579 | A1 | 7/2021 | Quanci et al. |
| 2021/0261877 | A1 | 8/2021 | Despen et al. |
| 2021/0340454 | A1 | 11/2021 | Quanci et al. |
| 2021/0363426 | A1 | 11/2021 | West et al. |
| 2021/0363427 | A1 | 11/2021 | Quanci et al. |
| 2021/0371752 | A1 | 12/2021 | Quanci et al. |
| 2021/0388270 | A1 | 12/2021 | Choi et al. |
| 2022/0056342 | A1 | 2/2022 | Quanci et al. |

FOREIGN PATENT DOCUMENTS

| | | | | |
|---|---|---|---|---|
| CA | 2822841 | | 7/2012 | |
| CA | 2822857 | | 7/2012 | |
| CA | 2905110 | A1 | 9/2014 | |
| CN | 87212113 | U | 6/1988 | |
| CN | 87107195 | A | 7/1988 | |
| CN | 2064363 | U | 10/1990 | |
| CN | 2139121 | Y | 7/1993 | |
| CN | 1092457 | A | 9/1994 | |
| CN | 1255528 | A | 6/2000 | |
| CN | 1270983 | A | 10/2000 | |
| CN | 2528771 | Y | 2/2002 | |
| CN | 1358822 | A | 7/2002 | |
| CN | 2521473 | Y | 11/2002 | |
| CN | 1468364 | A | 1/2004 | |
| CN | 1527872 | A | 9/2004 | |
| CN | 2668641 | | 1/2005 | |
| CN | 1957204 | A | 5/2007 | |
| CN | 101037603 | A | 9/2007 | |
| CN | 101058731 | A | 10/2007 | |
| CN | 101157874 | A | 4/2008 | |
| CN | 201121178 | Y | 9/2008 | |
| CN | 101395248 | A | 3/2009 | |
| CN | 100510004 | C | 7/2009 | |
| CN | 101486017 | A | 7/2009 | |
| CN | 201264981 | Y | 7/2009 | |
| CN | 101497835 | A | 8/2009 | |
| CN | 101509427 | A | 8/2009 | |
| CN | 101886466 | A | 11/2010 | |
| CN | 101910530 | A | 12/2010 | |
| CN | 102072829 | A | 5/2011 | |
| CN | 102155300 | A | 8/2011 | |
| CN | 2509188 | Y | 11/2011 | |
| CN | 202226816 | | 5/2012 | |
| CN | 202265541 | U | 6/2012 | |
| CN | 102584294 | A | 7/2012 | |
| CN | 202415446 | U | 9/2012 | |
| CN | 202470353 | U | 10/2012 | |
| CN | 103399536 | A | 11/2013 | |
| CN | 103468289 | A | 12/2013 | |
| CN | 103913193 | A | 7/2014 | |
| CN | 203981700 | U | 12/2014 | |
| CN | 105137947 | A | 12/2015 | |
| CN | 105189704 | A | 12/2015 | |
| CN | 105264448 | A | 1/2016 | |
| CN | 105467949 | A | 4/2016 | |
| CN | 106661456 | A | 5/2017 | |
| CN | 106687564 | A | 5/2017 | |
| CN | 107445633 | A | 12/2017 | |
| CN | 100500619 | C | 6/2020 | |
| DE | 201729 | C | 9/1908 | |
| DE | 212176 | | 7/1909 | |
| DE | 1212037 | B | 3/1966 | |
| DE | 2212544 | A | 1/1973 | |
| DE | 2720688 | A1 * | 11/1978 | ..... F23L 11/005 |
| DE | 3231697 | C1 | 1/1984 | |
| DE | 3328702 | A1 | 2/1984 | |
| DE | 3315738 | C2 | 3/1984 | |
| DE | 3329367 | C | 11/1984 | |
| DE | 3407487 | C1 | 6/1985 | |
| DE | 19545736 | | 6/1997 | |
| DE | 19803455 | | 8/1999 | |
| DE | 10122531 | A1 | 11/2002 | |
| DE | 10154785 | | 5/2003 | |
| DE | 102005015301 | | 10/2006 | |
| DE | 102006004669 | | 8/2007 | |
| DE | 102006026521 | | 12/2007 | |
| DE | 102009031436 | | 1/2011 | |
| DE | 102011052785 | | 12/2012 | |
| EA | 010510 | B1 * | 10/2008 | |
| EP | 0126399 | A1 | 11/1984 | |
| EP | 0208490 | | 1/1987 | |
| EP | 0903393 | A2 | 3/1999 | |
| EP | 1538503 | A1 | 6/2005 | |
| EP | 2295129 | | 3/2011 | |
| EP | 2468837 | A1 | 6/2012 | |
| FR | 2339664 | | 8/1977 | |
| FR | 2517802 | | 6/1983 | |
| FR | 2764978 | | 12/1998 | |
| GB | 364236 | A | 1/1932 | |
| GB | 368649 | A | 3/1932 | |
| GB | 441784 | | 1/1936 | |
| GB | 606340 | | 8/1948 | |
| GB | 611524 | | 11/1948 | |
| GB | 725865 | | 3/1955 | |
| GB | 871094 | | 6/1961 | |
| GB | 923205 | A | 5/1963 | |
| JP | S50148405 | | 12/1975 | |
| JP | S5319301 | A | 2/1978 | |
| JP | 54054101 | | 4/1979 | |
| JP | S5453103 | A | 4/1979 | |
| JP | 57051786 | | 3/1982 | |
| JP | 57051787 | | 3/1982 | |
| JP | 57083585 | | 5/1982 | |
| JP | 57090092 | | 6/1982 | |
| JP | S57172978 | A | 10/1982 | |
| JP | 58091788 | | 5/1983 | |
| JP | 59051978 | | 3/1984 | |
| JP | 59053589 | | 3/1984 | |
| JP | 59071388 | | 4/1984 | |
| JP | 59108083 | | 6/1984 | |
| JP | 59145281 | | 8/1984 | |
| JP | 60004588 | | 1/1985 | |
| JP | 61106690 | | 5/1986 | |
| JP | 62011794 | | 1/1987 | |
| JP | 62285980 | | 12/1987 | |
| JP | 01103694 | | 4/1989 | |
| JP | 01249886 | | 10/1989 | |
| JP | H0319127 | | 3/1991 | |
| JP | 03197588 | | 8/1991 | |
| JP | 04159392 | | 6/1992 | |
| JP | H04178494 | A | 6/1992 | |
| JP | H05230466 | A | 9/1993 | |
| JP | H0649450 | A | 2/1994 | |
| JP | H0654753 | U | 7/1994 | |
| JP | H06264062 | | 9/1994 | |
| JP | H06299156 | A | 10/1994 | |
| JP | 07188668 | | 7/1995 | |

(56) References Cited

FOREIGN PATENT DOCUMENTS

| | | | |
|---|---|---|---|
| JP | 07216357 | | 8/1995 |
| JP | H07204432 | | 8/1995 |
| JP | H0843314 | A | 2/1996 |
| JP | H08104875 | A | 4/1996 |
| JP | 08127778 | | 5/1996 |
| JP | H08218071 | A | 8/1996 |
| JP | H10273672 | A | 10/1998 |
| JP | H11-131074 | | 5/1999 |
| JP | H11256166 | A | 9/1999 |
| JP | 2000204373 | A | 7/2000 |
| JP | 2000219883 | A | 8/2000 |
| JP | 2001055576 | A | 2/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003071313 | A | 3/2003 |
| JP | 2003292968 | A | 10/2003 |
| JP | 2003342581 | A | 12/2003 |
| JP | 2004169016 | A | 6/2004 |
| JP | 2005503448 | A | 2/2005 |
| JP | 2005135422 | A | 5/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2007063420 | A | 3/2007 |
| JP | 3924064 | B2 | 6/2007 |
| JP | 4101226 | B2 | 6/2008 |
| JP | 2008231278 | A | 10/2008 |
| JP | 2009019106 | A | 1/2009 |
| JP | 2009073864 | A | 4/2009 |
| JP | 2009073865 | A | 4/2009 |
| JP | 2009135276 | A | 6/2009 |
| JP | 2009144121 | | 7/2009 |
| JP | 2010229239 | A | 10/2010 |
| JP | 2010248389 | A | 11/2010 |
| JP | 2011504947 | A | 2/2011 |
| JP | 2011068733 | A | 4/2011 |
| JP | 2011102351 | A | 5/2011 |
| JP | 2012102302 | | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| JP | 2015094091 | A | 5/2015 |
| JP | 2016169897 | A | 9/2016 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030012458 | A | 2/2003 |
| KR | 1020040020883 | A | 3/2004 |
| KR | 20040107204 | A | 12/2004 |
| KR | 1020050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20150011084 | A | 1/2015 |
| KR | 20170038102 | A | 4/2017 |
| KR | 20170058808 | A | 5/2017 |
| KR | 20170103857 | A | 9/2017 |
| KR | 101862491 | B1 | 5/2018 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2005023649 | | 3/2005 |
| WO | WO2005031297 | | 4/2005 |
| WO | WO2005115583 | | 12/2005 |
| WO | WO2007103649 | | 9/2007 |
| WO | WO2008034424 | | 3/2008 |
| WO | WO2008105269 | | 9/2008 |
| WO | WO2009147983 | | 12/2009 |
| WO | WO2010103992 | | 9/2010 |
| WO | WO2011000447 | | 1/2011 |
| WO | WO2011126043 | | 10/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |
| WO | WO2016033511 | | 3/2016 |
| WO | WO2016086322 | | 6/2016 |

OTHER PUBLICATIONS

Espacenet translation of EA-010510-B1.*

U.S. Appl. No. 16/828,448, filed Mar. 24, 2020, Quanci et al.

U.S. Appl. No. 16/845,530, filed Apr. 10, 2020, Quanci et al.

U.S. Appl. No. 16/897,957, filed Jun. 10, 2020, Ball et al.

U.S. Appl. No. 17/076,563, filed Oct. 21, 2020, Crum et al.

International Search Report and Written Opinion for PCT/US2019/068804; dated Apr. 29, 2020; 13 pages.

U.S. Appl. No. 16/428,014, filed May 31, 2019, Quanci et al.

U.S. Appl. No. 16/704,689, filed Dec. 5, 2019, West et al.

U.S. Appl. No. 16/729,036, filed Dec. 27, 2019, Quanci et al.

U.S. Appl. No. 16/729,057, filed Dec. 27, 2019, Quanci et al.

U.S. Appl. No. 16/729,068, filed Dec. 27, 2019, Quanci et al.

U.S. Appl. No. 16/729,122, filed Dec. 27, 2019, Quanci et al.

U.S. Appl. No. 16/729,129, filed Dec. 27, 2019, Quanci et al.

U.S. Appl. No. 16/729,157, filed Dec. 27, 2019, Quanci et al.

U.S. Appl. No. 16/729,170, filed Dec. 27, 2019, Quanci et al.

U.S. Appl. No. 16/729,201, filed Dec. 27, 2019, Quanci et al.

U.S. Appl. No. 16/729,212, filed Dec. 27, 2019, Quanci et al.

U.S. Appl. No. 16/729,219, filed Dec. 27, 2019, Quanci et al.

U.S. Appl. No. 16/735,103, filed Jan. 6, 2020, Quanci et al.

ASTM D5341-99(2010)e1, Standard Test Method for Measuring Coke Reactivity Index (CRI) and Coke Strength After Reaction (CSR), ASTM International, West Conshohocken, PA, 2010.

Astrom, et al., "Feedback Systems: An Introduction for Scientists and Engineers," Sep. 16, 2006, available on line at http://people/duke.edu/-hpgavin/SystemID/References/Astrom-Feedback-2006.pdf; 404 pages.

Basset et al., "Calculation of steady flow pressure loss coefficients for pipe junctions," Proc Instn Meeh Engrs., vol. 215, Part C, p. 861-881 IMechIE 2001.

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.

Bloom, et al., "Modular cast block—The future of coke oven repairs," Iron & Steel Technol, AIST, Warrendale, PA, vol. 4, No. 3, Mar. 1, 2007, pp. 61-64.

Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.

Clean coke process: process development studies by USS Engineers and Consultants, Inc., Wisconsin Tech Search, request date Oct. 5, 2011, 17 pages.

(56) References Cited

OTHER PUBLICATIONS

"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; An 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
Industrial Furnace Design Handbook, Editor-in-Chief: First Design Institute of First Ministry of Machinery Industry, Beijing: Mechanical Industry Press, pp. 180-183, Oct. 1981.
Joseph, B., "A tutorial on inferential control and its applications," Proceedings of the 1999 American Control Conference (Cat. No. 99CH36251), San Diego, CA, 1999, pp. 3106-3118 vol. 5.
JP 03-197588, Inoue Keizo et al., Method And Equipment For Boring Degassing Hole In Coal Charge In Coke Oven, Japanese Patent (Abstract Only) Aug. 28, 1991.
JP 04-159392, Inoue Keizo et al., Method And Equipment For Opening Hole For Degassing Of Coal Charge In Coke Oven, Japanese Patent (Abstract Only) Jun. 2, 1992.
Kerlin, Thomas (1999), Practical Thermocouple Thermometry-1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"Middletown Coke Company HRSG Maintenance BACT Analysis Option 1-Individual Spray Quenches Sun Heat Recovery Coke Facility Process Flow Diagram Middletown Coke Company 100 Oven Case -24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7** pp. 8-11 *.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
"Resources and Utilization of Coking Coal in China," Mingxin Shen ed., Chemical Industry Press, first edition, Jan. 2007, pp. 242-243, 247.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al., "Sun Coke Company's heat recovery cokemaking technology high coke quality and low environmental impact", Revue De Metallurgie—Cahiers D'informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
U.S. Appl. No. 13/631,215, filed Sep. 28, 2012, now U.S. Pat. No. 9,683,740, titles Methods for Handling Coal Processing Emissions and Associated Systems and Devices.
U.S. Appl. No. 14/921,723, filed Oct. 23, 2015, titled Reduced Output Rate Coke Oven Operation with Gas Sharing Providing Extended Process Cycle.
U.S. Appl. No. 14/655,204, filed Jun. 24, 2015, titled Systems and Methods for Removing Mercury from Emissions.
U.S. Appl. No. 16/000,516, filed Jun. 5, 2018, titled Systems and Methods for Removing Mercury from Emissions.
U.S. Appl. No. 16,026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, titled Methods and Systems for Improved Coke Quenching.
U.S. Appl. No. 14,655,013, filed Jun. 23, 2015, titled Vent Stack Lids and Associated Systems and Methods.
U.S. Appl. No. 13/843,166, now U.S. Pat. No. 9,273,250, filed Mar. 15, 2013, title Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 15/511,036, filed Mar. 14, 2017, titled Coke Ovens Having Monolith Component Construction.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 16/047,198, filed Jul. 27, 2018, titled Coke Plant Including Exhaust Gas Sharing.
U.S. Appl. No. 13/730,673, filed Dec. 28, 2012, title Exhaust Flow Modifier, Duct Intersection Incorporating the Same, and Methods Therefor.
U.S. Appl. No. 15/281/891, filed Sep. 30, 2016, title Exhaust Flow Modifier, Duct Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/839,384, filed Aug. 28, 2015, titled Coke Oven Charging System.
U.S. Appl. No. 14/587,670, filed Dec. 31, 2014, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 16/251,352, filed Jan. 18, 2019, titled Method and System for Optimizing Coke Plant Operation and Output.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 17/155,818, filed Jan. 22, 2021, Choi et al.
U.S. Appl. No. 17/190,720, filed Mar. 3, 2021, West et al.
U.S. Appl. No. 17/191,119, filed Mar. 3, 2021, Quanci et al.
U.S. Appl. No. 17/222,886, filed Apr. 5, 2021, Quanci et al.

(56) References Cited

OTHER PUBLICATIONS

U.S. Appl. No. 17/228,469, filed Apr. 12, 2021, Quanci et al.
U.S. Appl. No. 17/228,501, filed Apr. 12, 2021, Quanci et al.
U.S. Appl. No. 17/306,895, filed May 3, 2021, Quanci et al.
U.S. Appl. No. 17/320,343, filed May 24, 2021, Quanci et al.
U.S. Appl. No. 17/321,857, filed May 17, 2021, Quanci et al.
U.S. Appl. No. 17/363,701, filed Jun. 30, 2021, Quanci et al.
U.S. Appl. No. 17/388,874, filed Jul. 29, 2021, Quanci et al.
U.S. Appl. No. 17/459,380, filed Aug. 27, 2021, Quanci et al.
U.S. Appl. No. 17/471,491, filed Sep. 10, 2021, West et al.
U.S. Appl. No. 17/521,061, filed Nov. 8, 2021, Crum et al.
U.S. Appl. No. 17/526,477, filed Nov. 15, 2021, Quanci et al.
U.S. Appl. No. 17/532,058, filed Nov. 22, 2021, Quanci et al.
De Cordova, et al. "Coke oven life prolongation—A multidisciplinary approach." 10.5151/2594-357X-2610 (2015) 12 pages.
Lin, Rongying et al., "Study on the synergistic effect of calcium and aluminum on improving ash fusion temperature of semi-coke," International Journal of Coal Preparation and Utilization, May 31, 2019 (published online), vol. 42, No. 3, pp. 556-564.
Lipunov, et al. "Diagnostics of the Heating Systgem and Lining of Coke Ovens," Coke and Chemistry, 2014, Vopl. 57, No. 12, pp. 489-492.
Brazilian Office Action in Brazilian Applcation No. BR112021012500-0; dated Apr. 11, 2023; 7 pages.
U.S. Appl. No. 07/587,742, filed Sep. 25, 1990, now U.S. Pat. No. 5,114,542, titled Nonrecovery Coke Oven Battery And Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable in Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/655,204, now U.S. Pat. No. 10,016,714, filed Jun. 24, 2015, titled Systems and Methods for Removing Mercury From Emissions.
U.S. Appl. No. 16/000,516, now U.S. Pat. No. 11,117,087, filed Jun. 5, 2018, titled Systems and Methods for Removing Mercury From Emissions.
U.S. Appl. No. 17/459,380, filed Jun. 5, 2018, titled Systems and Methods for Removing Mercury From Emissions.
U.S. Appl. No. 13/830,971, filed Mar. 14, 2013, now U.S. Pat.No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, now U.S. Pat. No. 11,008,517, titled Non-Perpendicular Connections Between Coke Oven Uptakes and a Hot Common Tunnel, and Associated Systems and Methods.
U.S. Appl. No. 13/730,796, filed Dec. 28, 2012, now U.S. Pat. No. 10,883,051, titled Methods and Systems for Improved Coke Quenching.
U.S. Appl. No. 17/140,564, filed Jan. 4, 2021, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, now U.S. Pat. No. 11,142,699, titled Vent Stack Lids and Associated Systems and Methods.
U.S. Appl. No. 17/471,491, filed Sep. 10, 2021, now U.S. Pat. No. 11,142,699, titled Vent Stack Lids and Associated Systems and Methods.
U.S. Appl. No. 13/843,166, filed Mar. 15, 2013, now U.S. Pat. No. 9,273,250, titled Methods and Systems for Improved Quench Tower Design.
U.S. Appl. No. 15/014,547, filed Feb. 3, 2016, now, U.S. Pat. No. 10,927,303, titled Methods for Improved Quench Tower Design.
U.S. Appl. No. 17/155,818, filed Jan. 22, 2021, titled Methods and Systems for Improved Quench Tower Design.
U.S. Appl. No. 14/655,003, filed Jun. 23, 2015, now U.S. Pat. No. 10,760,002, titled Systems and Methods for Maintaining a Hot Car in a Coke Plant.
U.S. Appl. No. 16/897,957, filed Jun. 10, 2020, now U.S. Pat. No. 11,359,145, titled Systems and Methods for Maintaining a Hot Car in a Coke Plant.
U.S. Appl. No. 13/829,588, filed Mar. 14, 2013, now U.S. Pat. No. 9,193,915, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, now U.S. Pat. No. 10,968,383, titled Coke Ovens Having Monolith Component Construction.
U.S. Appl. No. 17/190,720, filed Mar. 3, 2021, titled Coke Ovens Having Monolith Component Construction.
U.S. Appl. No. 13/589,009, filed Aug. 17, 2012, now U.S. Pat. No. 9,359,554, titled Automatic Draft Control System for Coke Plants.
U.S. Appl. No. 15/139,568, filed Apr. 27, 2016, now U.S. Pat. No. 10,947,455, titled Automatic Draft Control System for Coke Plants.
U.S. Appl. No. 17/176,391, filed Feb. 16, 2021, titled Automatic Draft Control System for Coke Plants.
U.S. Appl. No. 13/588,996, filed Aug. 17, 2012, now U.S. Pat. No. 9,243,186, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing.
U.S. Appl. No. 16/047,198, filed Jul. 27,2018, now U.S. Pat. No. 10,611,965, titled Coke Plant Including Exhaust Gas Sharing.

(56) References Cited

OTHER PUBLICATIONS

U.S. Appl. No. 16/828,448, filed Mar. 24, 2020, now U.S. Pat. No. 11,441,077, titled Coke Plant Including Exhaust Gas Sharing.
U.S. Appl. No. 13/589,004, filed Aug. 17, 2012, now U.S. Pat. No. 9,249,357, titled Method and Apparatus for Volatile Matter Sharing in Stamp-Charged Coke Ovens.
U.S. Appl. No. 13/730,673, filed Dec. 28, 2012, now U.S. Pat. No. 9,476,547, titled Exhaust Flow Modifier, Duct Intersection Incorporating the Same, and Methods Therefor.
U.S. Appl. No. 15/281,891, filed Sep. 30, 2016, now U.S. Pat. No. 10,975,309, titled Exhaust Flow Modifier, Duck Intersection Incorporating the Same, and Methods Therefor.
U.S. Appl. No. 17/191,119, filed Mar. 3, 3021, titled Exhaust Flow Modifier, Duck Intersection Incorporating the Same, and Methods Therefor.
U.S. Appl. No. 13/598,394, filed Aug. 29, 2012, now U.S. Pat. No. 9,169,439, titled Method and Apparatus for Testing Coal Coking Properties.
U.S. Appl. No. 14/865,581, filed Sep.25, 2015, now U.S. Pat. No. 10,053,627, titled Method and Apparatus for Testing Coal Coking Properties, Now U.S. Pat. No. 10,053,627.
U.S. Appl. No. 14/839,384, filed Aug. 28, 2015, now U.S. Pat. No. 9,580,656, titled Coke Oven Charging System.
U.S. Appl. No. 15/443,246, filed Feb. 27, 2017, now U.S. Pat. No. 9,976,089, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, now U.S. Pat. No. 11,359,146, titled Methods for Decarbonizing Coking Ovens, and Associated Systems and Devices.
U.S. Appl. No. 14/984,489, filed Dec. 30, 2015, now U.S. Pat. No. 10,975,310, titled Multi-Modal Beds of Coking Material.
U.S. Appl. No. 14/983,837, filed Dec. 30, 2015, now U.S. Pat. No. 10,968,395, titled Multi-Modal Beds of Coking Material.
U.S. Appl. No. 14/986,281, filed Dec. 31, 2015, now U.S. Pat. No. 10,975,311, titled Multi-Modal Beds of Coking Material.
U.S. Appl. No. 17/222,886, filed Apr. 12, 2021, titled Multi- Modal Beds of Coking Material.
U.S. Appl. No. 14/987,625, filed Jan. 4, 2016, now U.S. Pat. No. 11,060,032, titled Integrated Coke Plant Automation and Optimization Using Advanced Control and Optimization Techniques.
U.S. Appl. No. 17/172,476, filed Feb. 10, 2021, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, now U.S. Pat. No. 11,053,444, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, now U.S. Pat. No. 10,920,148, titled Improved Burn Profiles for Coke Operations.
U.S. Appl. No. 17/155,719, filed Jan. 22, 2021, now US. Pat. No. 11,441,078, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, now U.S. Pat. No. 11,214,739, titled Method and System for Dynamically Charging a Coke Oven.
U.S. Appl. No. 15/614,525, filed Jun. 5, 2017, now U.S. Pat. No. 11,508,230, titled Methods and Systems for Automatically Generating a Remedial Action in an Industrial Facility.
U.S. Appl. No. 18/047,916, filed Oct. 19, 2022, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, now U.S. Pat. No. 11,186,778, titled System and Method for Repairing a Coke Oven.
U.S. Appl. No. 17/521,061, filed Nov. 8, 2021, titled System and Method for Repairing a Coke Oven.
U.S. Appl. No. 17/135,483, filed Dec. 28, 2020, titled Oven Health Optimization Systems and Methods.
U.S. Appl. No. 16/729,036, filed Dec. 27, 2019, now U.S. Pat. No. 11,365,355, titled Systems and Methods for Treating a Surface of a Coke Plant.
U.S. Appl. No. 17/747,708, filed May 18, 2022, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, now U.S. Pat. No. 11,395,989, titled Methods and Systems for Providing Corrosion Resistant Surfaces in Contaminant Treatment Systems.
U.S. Appl. No. 17/843,164, filed Jun. 17, 2022, titled Methods and Systems for Providing Corrosion Resistant Surfaces in Contaminant Treatment Systems.
U.S. Appl. No. 16/729,068, filed Dec. 27, 2019, now U.S. Pat. No. 11,486,572, titled Systems and Methods for Utilizing Flue Gas.
U.S. Appl. No. 17/947,520 filed Sep. 19, 2022, titled Systems and Methods for Utilizing Flue Gas.
U.S. Appl. No. 16/729,129, filed Dec. 27, 2019, now U.S. Pat. No. 11,008,518, titled Coke Plant Tunnel Repair and Flexible Joints.
U.S. Appl. No. 17/320,343, filed May 14,2021, now U.S. Pat. No. 11,597,881, titled Coke Plant Tunnel Repair and Flexible Joints.
U.S. Appl. No. 18/168,142, filed Feb. 13, 2023, titled Coke Plant Tunnel Repair and Flexible Joints.
U.S. Appl. No. 16/729,170, now U.S. Pat. No. 11,193,069, filed Dec. 27, 2019, titled Coke Plant Tunnel Repair and Anchor Distribution.
U.S. Appl. No. 17/532,058, now U.S. Pat. No. 11,505,747, filed Nov. 22, 2021, titled Coke Plant Tunnel Repair and Anchor Distribution.
U.S. Appl. No. 17/967,615, filed Oct. 17, 2022, titled Coke Plant Tunnel Repair and Anchor Distribution.
U.S. Appl. No. 16/729,157, filed Dec. 27, 2019, now U.S. Pat. No. 11,071,935, titled Particulate Detection for Industrial Facilities, and Associated Systems and Methods.
U.S. Appl. No. 16/729,057, filed Dec. 27, 2019, now U.S. Pat. No. 11,021,655, titled Decarbonization of Coke Ovens and Associated Systems and Methods.
U.S. Appl. No. 17/321,857, filed May 17, 2021, titled Decarbonization of Coke Ovens and Associated Systems and Methods.
U.S. Appl. No. 16/729,212, filed Dec. 27, 2019, now U.S. Pat. No. 11,261,381, titled Heat Recovery Oven Foundation.
U.S. Appl. No. 17/584,672, filed Jan. 26, 2022, titled Heat Recovery Oven Foundation.
U.S. Appl. No. 16/729,219, now U.S. Pat. No. 11,098,252, filed Dec. 27, 2019, titled Spring-Loaded Heat Recovery Oven System and Method.
U.S. Appl. No. 17/388,874, filed Jul. 29, 2021, titled Spring-Loaded Heat Recovery Oven System and Method.
U.S. Appl. No. 17/736,960, filed May 20, 2022, titled Foundry Coke Products, and Associated Systems and Methods.
U.S. Appl. No. 17/306,895, filed May 3, 2021, titled High-Quality Coke Products.
U.S. Appl. No. 18/052,739, filed Nov. 4, 2022, titled Foundry Coke Products and Associated Processing Methods via Cupolas.
U.S. Appl. No. 18/052,760, filed Nov. 2, 2022, titled Foundry Coke Products, and Associated Systems, Devices, and Methods.

* cited by examiner

OVEN UPTAKES

CROSS-REFERENCE TO RELATED APPLICATION(S)

This non-provisional patent application claims the benefit of and priority to U.S. Provisional Patent Application No. 62/786,027, title "OVEN UPTAKES" and filed Dec. 28, 2018, which is incorporated by reference herein in its entirety by reference thereto.

TECHNICAL FIELD

The present technology relates to coke ovens and in particular to systems for regulating oven draft within the coke oven to control the coking process.

BACKGROUND

Coke is a solid carbon fuel and carbon source used to melt and reduce iron ore in the production of steel. Coking ovens have been used for many years to convert coal into metallurgical coke. In one process, known as the "Thompson Coking Process," coke is produced by batch feeding pulverized coal to an oven that is sealed and heated to very high temperatures for 24 to 48 hours under closely-controlled atmospheric conditions. During the coking process, the finely crushed coal devolatilizes and forms a fused mass of coke having a predetermined porosity and strength. Because the production of coke is a batch process, multiple coke ovens are operated simultaneously. To ensure that the coking rate is consistent throughout all of the ovens in a plant and to ensure that the quality of coke remains consistent between batches, the operating conditions of the coke ovens are closely monitored and controlled.

One operating condition for the coke ovens that is of particular importance is the oven draft within the coke ovens. During operation of the coke oven, fresh air from outside of the coke oven is drawn into the chamber to facilitate the coking process. The mass of coal emits hot exhaust gases (i.e. flue gas) as it bakes, and these gases are drawn into a network of ducts fluidly connected to the oven chamber. The ducts carry the exhaust gas to a sole flue below the oven chamber and the high temperatures within the sole flue cause the exhaust gas to combust and emit heat that help to further the coking reaction within the chamber. The combusted exhaust gases are then drawn out of the sole flue and are directed into a common tunnel, which transports the gases downstream for further processing.

However, allowing the exhaust gases to freely flow out into the common tunnel can reduce the quality of the coke produced within the oven. To regulate and control the flow of exhaust gases, coke ovens typically include dampers positioned between the sole flue and the common tunnel. These dampers typically include ceramic blocks that are moved into and out of the duct carrying the exhaust gases to adjust the flow rate and pressure of the exhaust gases. However, these ceramic blocks are often simultaneously exposed to the high-temperature exhaust gases within the ducts and room-temperature air outside of the ducts, resulting in the blocks being unevenly heated and leading to the formation of large temperature gradients within the blocks. This can cause the individual blocks to expand and contract unevenly, which can cause internal stresses within the ceramic material that causes the blocks to crack and fail. Additionally, this uneven heating and cooling makes the blocks more prone to ash deposition, which can cause the blocks to become fouled and plugged and can impede the operation of the blocks. Conventional dampers have large sections of the damper blocks located outside the gas path and outside the uptake itself. This leads to large cross section of block outside of the system and a large area for potential of air in leakage. Air in leakage impedes the performance of the system by leading to higher mass flows that lead to higher draft loss and reduction of draft to the ovens. In the case of heat recovery ovens this also leads to the reduction of power that can be recovered from the hot flue gas. Accordingly, there is a need for an improved damper system that is not prone to failing due to cracks caused by large thermal gradients.

DETAILED DESCRIPTION

Specific details of several embodiments of the disclosed technology are described below with reference to particular, representative configuration. The disclosed technology can be practiced in accordance with ovens, coke manufacturing facilities, and insulation and heat shielding structures having other suitable configurations. Specific details describing structures or processes that are well-known and often associated with coke ovens but that can unnecessarily obscure some significant aspects of the presently disclosed technology, are not set forth in the following description for clarity. Moreover, although the following disclosure sets forth some embodiments of the different aspects of the disclosed technology, some embodiments of the technology can have configurations and/or components different than those described in this section. As such, the present technology can include some embodiments with additional elements and/or without several of the elements described below with reference to FIGS. 1-19D.

Figure 1:
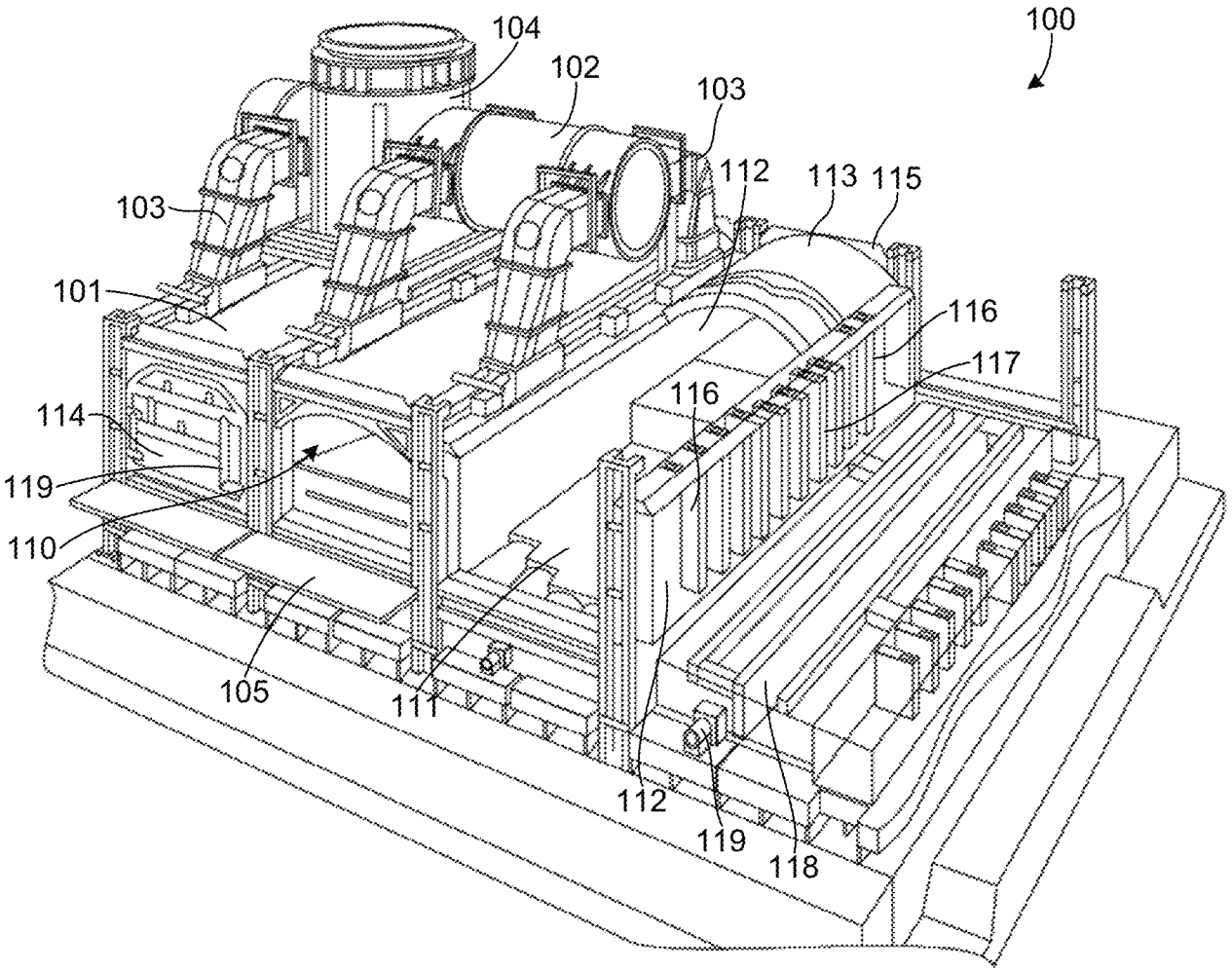
FIG. 1 is an isometric, partial cut-away view of a portion of a horizontal heat recovery/non-recovery coke plant configured in accordance with embodiments of the present technology.

Referring to FIG. 1, a coke plant 100 is illustrated which produces coke from coal in a reducing environment. In general, the coke plant 100 comprises at least one oven 101, along with heat recovery steam generators and an air quality control system (e.g. an exhaust or flue gas desulfurization system) both of which are positioned fluidly downstream from the ovens and both of which are fluidly connected to the ovens by suitable ducts. According to aspects of the disclosure, the coke plant can include a heat recovery or a non-heat recovery coke oven, or a horizontal heat recovery or horizontal non-recovery coke oven. The coke plant 100 preferably includes a plurality of ovens 101 and a common tunnel 102 that is fluidly connected to each of the ovens 101 with uptake ducts 103. A cooled gas duct transports the cooled gas from the heat recovery steam generators to the flue gas desulfurization system. Fluidly connected and further downstream are a baghouse for collecting particulates, at least one draft fan for controlling air pressure within the system, and a main gas stack for exhausting cooled, treated exhaust to the environment. Steam lines interconnect the heat recovery steam generators and a cogeneration plant so that the recovered heat can be utilized. The coke plant 100 can also be fluidly connected to a bypass exhaust stack 104 that can be used to vent hot exhaust gasses to the atmosphere in emergency situations.

FIG. 1 illustrates four ovens 101 with sections cut away for clarity. Each oven 101 comprises an oven chamber 110 preferably defined by a floor 111, a front door 114, a rear door 115 preferably opposite the front door 114, two sidewalls 112 extending upwardly from the floor 111 intermediate the front 114 and rear 115 doors, and a crown 113 which forms the top surface of the oven chamber 110. The oven 101 can also include a platform 105 adjacent to the front door 114 that a worker can stand and walk on to access the front door and the oven chamber 110. In operation, coke is produced in the ovens 101 by first loading coal into the oven chamber 110, heating the coal in an oxygen depleted environment, driving off the volatile fraction of coal and then oxidizing the volatiles within the oven 101 to capture and utilize the heat given off. The coal volatiles are oxidized within the ovens over a 48-hour coking cycle and release heat to regeneratively drive the carbonization of the coal to coke. The coking cycle begins when the front door 114 is opened and coal is charged onto the floor 111. The coal on the floor 111 is known as the coal bed. Heat from the oven (due to the previous coking cycle) starts the carbonization cycle. Preferably, no additional fuel other than that produced by the coking process is used. Roughly half of the total heat transfer to the coal bed is radiated down onto the top surface of the coal bed from the luminous flame and radiant oven crown 113. The remaining half of the heat is transferred to the coal bed by conduction from the floor 111 which is convectively heated from the volatilization of gases in sole flue 118. In this way, a carbonization process "wave" of plastic flow of the coal particles and formation of high strength cohesive coke proceeds from both the top and bottom boundaries of the coal bed at the same rate, preferably meeting at the center of the coal bed after about 45-48 hours.

In operation, volatile gases emitted from the coal positioned inside the oven chamber 110 collect in the crown 113 and are drawn downstream in the overall system into downcomer channels 117 formed in one or both sidewalls 112. The downcomer channels 117 fluidly connect the oven chamber 110 with the sole flue 118 positioned. The sole flue 118 forms a circuitous path beneath the floor 111 and volatile gases emitted from the coal can pass through the downcomer channels 117 and enter the sole flue 118, where they combust and emit heat that supports the reduction of coal into coke. Uptake channels 116 are formed in one or both sidewalls 112 of the oven chambers 110 and are fluidly coupled between the sole flue 118 and uptake ducts 103 such that the combusted volatile gases can leave the sole flue 118 by passing through the uptake channels 116 toward the uptake ducts 103. The uptake ducts 103 direct the volatile gases into the common tunnel 102, which transports these gases downstream for further processing.

Controlling air flow and pressure inside the oven 101 can be critical to the efficient operation of the coking cycle. Accordingly, the oven 101 includes multiple apparatuses configured to help regulate and control the oven draft within the oven 110. For example, in the illustrated embodiment, the oven 101 includes one or more air inlets 119 that allow air into the oven 101. Each air inlet 119 includes an air damper which can be positioned at any number of positions between fully open and fully closed to vary the amount of primary air flow into the oven 101. In the illustrated embodiment, the oven 101 includes an air inlet 119 coupled to the front door 114, which is configured to control air flow into the oven chamber 110, and an air inlet 119 coupled to a sole flue 118 positioned beneath the floor 111 of the oven 101. Alternatively, the one or more air inlets 119 are formed through the crown 113 and/or in uptake ducts 103. The air inlet 119 coupled to the sole flue 118 can fluidly connect the sole flue 118 to the atmosphere and can be used to control combustion within the sole flue.

Figure 2:
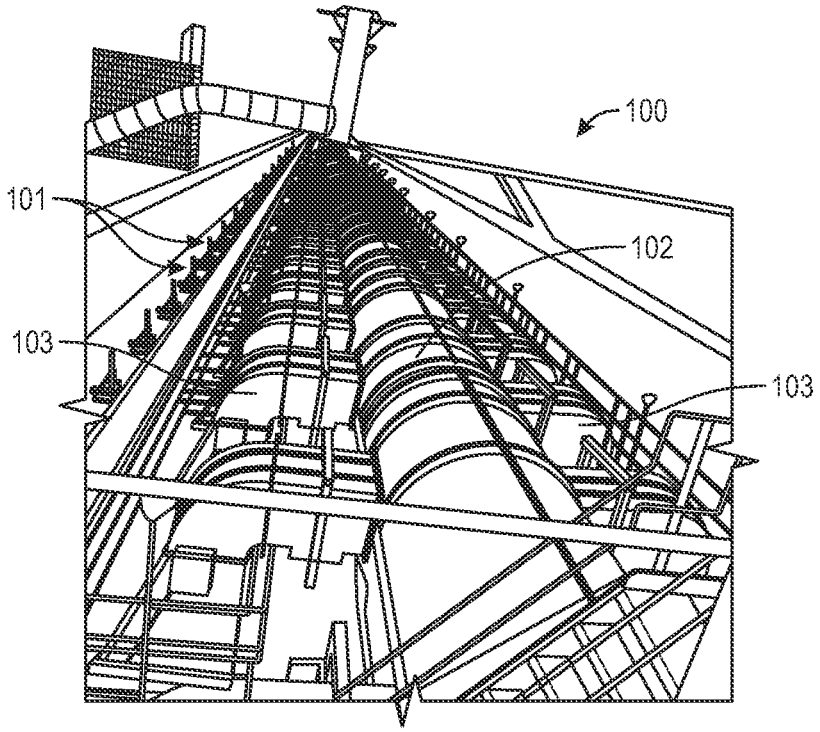
FIG. 2 is a perspective view of a common tunnel and a plurality of uptake ducts coupled to the common tunnel, in accordance with embodiments of the present technology.
Figure 3:
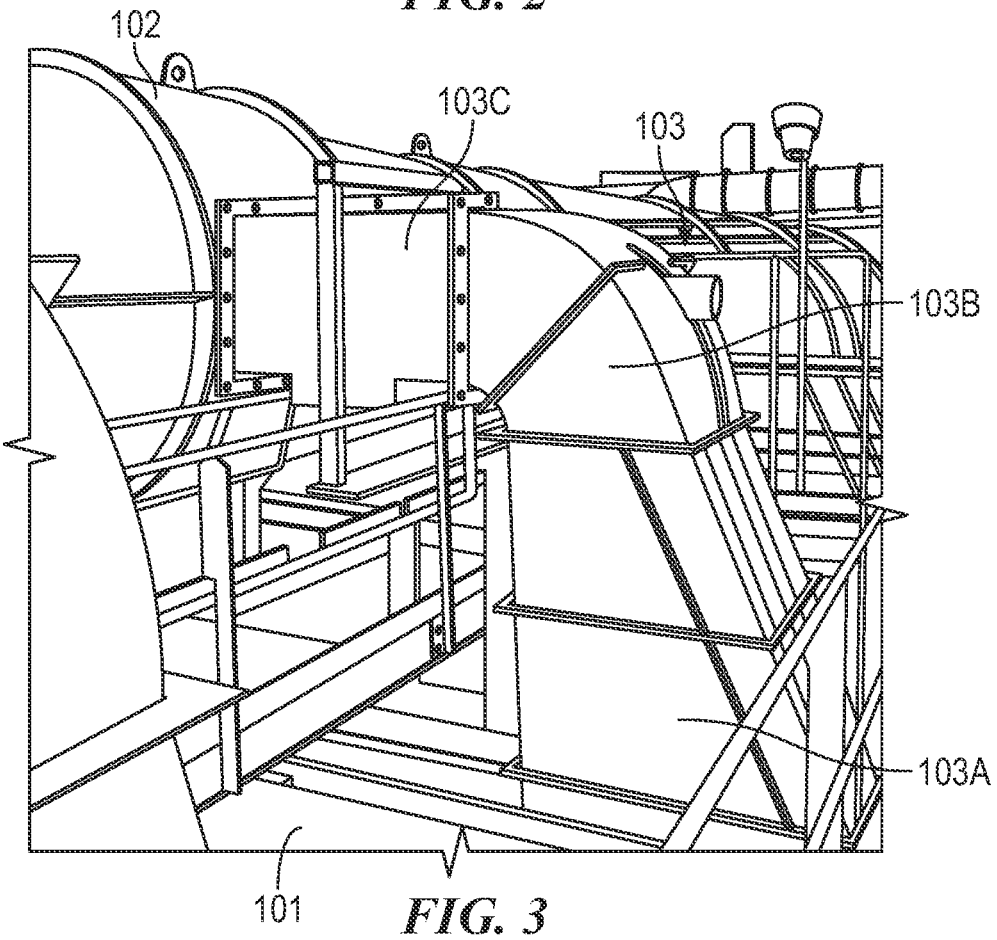
FIG. 3 is an isometric view of one of the uptake ducts shown in FIG. 2.

FIG. 2 shows a perspective view of the coke plant 100 and FIG. 3 shows an isometric view of an uptake duct 103 fluidly coupled between the common tunnel 102 and one of the ovens 101. In the illustrated embodiment, each of the ovens 101 includes two uptake ducts 103 that fluidly couple the ovens 101 to the common tunnel 102. In other embodiments, each of the ovens 101 can be coupled to the common tunnel 102 with a single uptake duct 103 or can be coupled with more than two uptake ducts 103. Alternatively, in some embodiments, adjacent ovens 101 can share uptake ducts 103 such that a single uptake duct 103 can fluidly couple two ovens 101 to the common tunnel 102. In general, any suitable number of uptake ducts 103 can be used to fluidly couple the ovens 101 to the common tunnel 102.

Each of the uptake ducts 103 can have a generally bent configuration and can be formed from a vertical segment 103A, a bent segment 103B, and a horizontal segment 103C, where the bent segment 103B fluidly couples the vertical and horizontal segments 103A and 103C together. The vertical segment 103A, which can extend generally upward from a top surface of the oven 101, can receive exhaust gas from at least some of the uptake channels within a given one of the sidewalls and direct the gas toward the bent segment 103B. The horizontal segment 103C is coupled between the common tunnel 102 and the bent segment 103B and is positioned to receive the exhaust gas from the bent segment 103B and provide the gas to the common tunnel 102, which directs the gas downstream for further processing. In the illustrated embodiment, the horizontal segment 103C is coupled to the common tunnel 102 such that the horizontal segment 103C is generally orthogonal to the common tunnel 102. In other embodiments, however, the horizontal segment 103C can be coupled to the common tunnel 102 at an angle other than 90°.

While the one or more air inlets 119 can be used to control how much outside air can flow into the oven 101, the air inlets 119 may not be able to directly regulate the flow of exhaust gases leaving the oven 101 via the uptake channels 116 and uptake ducts 103. Accordingly, to control the flow of exhaust gas out of the oven 101 and oven draft/vacuum, the uptake ducts 103 can include uptake dampers configured to restrict the flow of exhaust gases out of the oven 101. Embodiments of the technology described herein generally relate to dampers and damper systems suitable for use in controlling the flow of exhaust gas and/or oven draft. In some embodiments, the damper is configured to more between a plurality of orientations to thereby change exhaust gas flow and/or oven draft. However, regardless of the orientation of the damper, the entire damper remains in the duct/channel. In some embodiments, the damper forms part of a damper system, which can include, e.g., the damper, valves, controllers, etc., and each component of the damper system remains in the duct/channel regardless of the orientation of the damper. The damper system can further include an actuator used to move the damper to different possible damper orientations. The actuator can be located within the duct/channel, outside the duct/channel, or partially inside and partially outside the duct channel (which includes embodiments where the actuator moves between being inside and outside of the duct/channel). In embodiments where the actuator is located within the duct/channel, the actuator may remain entirely within the duct/channel regardless of the orientation of the damper.

The damper of the damper system that is disposed within and remains within the duct/channel can be any suitable type of damper. As discussed in greater detail below, the damper can be, for example, a damper plate, a plurality of damper plates, a block, a plurality of blocks, a rotatable cylinder, or a plurality of rotatable cylinders. Other suitable dampers include valves, such as butterfly valves. Generally speaking, any structure that can alter the flow of exhaust gas via change in orientation within the channel/duct can be used as the damper.

Figure 4:
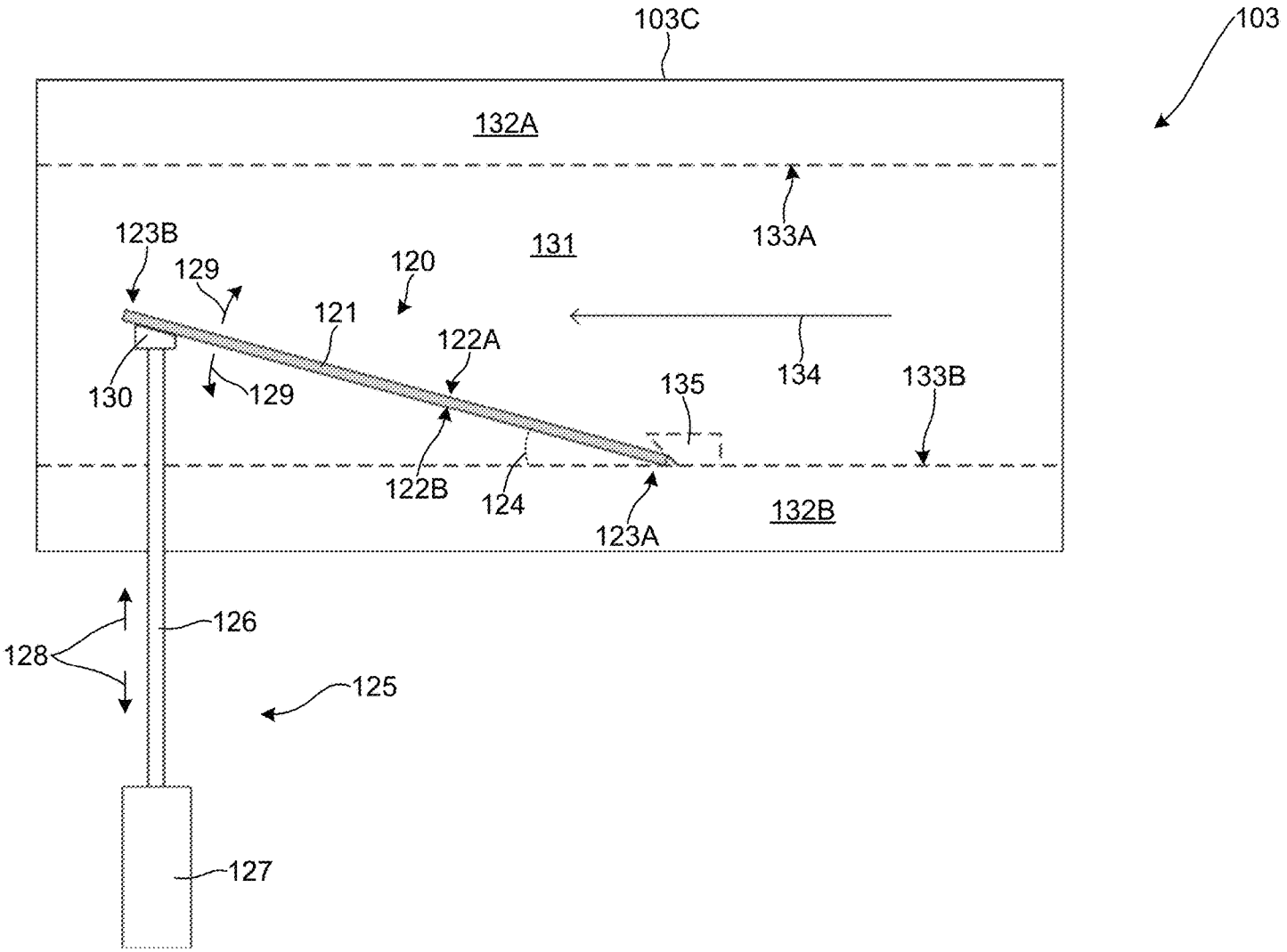
FIG. 4 is a diagram of an uptake damper system configured in accordance with embodiments of the present technology.

FIG. 4 shows a diagram of an uptake damper 120 positioned within the horizontal segment 103C of the uptake duct 103 and configured in accordance with embodiments of the present technology. The horizontal segment 103C includes upper and lower walls 132A and 132B, where a first refractory surface 133A of the upper wall 132A and a second refractory surface 133B of the lower wall 132B at least partially define a channel 131. The channel 131 is fluidly coupled to the oven and exhaust gases received from the oven can move toward the common tunnel 102 by flowing in the direction shown by arrow 134. The uptake damper 120 includes a damper plate 121 having top and bottom surfaces 122A and 122B, where the damper plate 121 is positioned such that the top surface 122A faces generally toward the upper wall 132A while the bottom surface 122B faces generally toward the lower wall 1328. In the illustrated embodiments, the uptake duct 103 has a generally rectangular cross-section and the damper plate 121, accordingly, also has a rectangular shape. In other embodiments, however, the uptake duct 103 can have a generally circular cross-section and the damper plate 121 is sized and shaped to conform to the shape of uptake duct 103.

The damper plate 121 includes first and second end portions 123A and 123B, where the first end portion 123A is pivotably coupled to the second refractory surface 133B while the second end portion 123B is not coupled to the second refractory surface 133B. With this arrangement, the damper plate 121 can be moved to a selected orientation by moving the damper plate 121 in the directions shown by arrows 129 about the first end portion 123A until an angle 124 formed between the bottom surface 122B and the second refractory surface 133B reaches a selected angle. As the damper plate 121 moves between orientations, the distance between the second end portion 123B and the first refractory surface 133A changes. Accordingly, the uptake damper 120 can be movable between an infinite number of configurations by moving the damper plate to different orientations. In this way, the uptake damper 120 can be used to control and regulate the flow of gases moving through the channel 131, which can affect the oven draft within the oven 101, as the orientation of the damper plate 121 affects the ability of the gases within the channel 131 to flow past the uptake damper 120.

For example, the uptake damper 120 can be moved to a completely-open configuration in which the uptake damper 120 does not significantly affect the ability of the exhaust gases to flow through the channel 131 in the direction 134. In this configuration, the damper plate 121 is oriented such that the bottom surface 122B is positioned against the second refractory surface 133B, the angle 124 is approximately equal to 0°, and the distance between the second end portion 123B and the first refractory surface 133A is at a maximum. Conversely, the uptake damper 120 can also be moved to a closed configuration that significantly restricts the ability of the exhaust gases to flow through the channel 131. In this configuration, the damper plate 121 is oriented such that the second end portion 123B is positioned closely adjacent to the first refractory surface 133A and the angle 124 is at a maximum value that is greater than 0°. Accordingly, when the uptake damper 120 is in the closed configuration, the damper plate 121 can cause the flow rate within the channel 131 to significantly decrease. As a result, the pressure within the channel 131 increases, which results in the pressure within the uptake channels 116, the sole flue 118, the downcomer channels 117, and the oven chamber 110 to also increase. In some embodiments, when the uptake damper 120 is in the closed configuration, the maximum value of the angle 124 can be approximately 45°. In other embodiments, however, the maximum value of the angle 124 can be some other angle generally determined by the dimensions of the damper plate 121 and the distance between the first and second refractory surfaces 133A and 133B. To further increase the ability of the uptake damper 120 to seal-off the channel 131 when the uptake damper 120 is in the closed configuration, in some embodiments, the horizontal segment 103C can include a lip attached to the first refractory surface 133A and positioned such that the second end portion 123B is positioned against the lip. In this way, the lip can help to prevent exhaust gas from flowing between the second edge portion 123B and the first refractory surface 133A when the uptake damper 120 is in the closed configuration.

The uptake damper 120 can also be moved to any configuration between the completely-open and closed configurations. For example, when the uptake damper 120 is in the configuration shown in FIG. 4, the damper plate 121 is oriented such that the angle 124 is approximately 15° and the second end portion 123B is located at roughly a midpoint between the first and second refractory surfaces 133A and 133B such that the distance between the second end portion 123B and the first refractory surface 133A is approximately equal to the distance between second end portion 123B and the second refractory surface 133B. Accordingly, when in this configuration, the amount of space for the exhaust gases to flow through, and therefore the flow rate of the exhaust gases within the channel 131, is less than when the uptake damper 120 is in the completely-open configuration but more than when the uptake damper 120 is in the closed configuration. As a result, the pressure within the channel 131, and therefore the pressure within the uptake channels 116, the sole flue 118, the downcomer channels 117, and the oven chamber 110, is greater than when the uptake damper 120 is in the completely-open configuration but less than when the uptake damper 120 is in the closed configuration. In this way, moving the uptake damper 120 to a selected configuration can allow the uptake damper to help control and regulate the oven draft within the oven chamber 110.

To cause the uptake damper 120 to move between the various configurations, the uptake damper 120 can include an actuator apparatus 125 configured to help move the damper plate 121 to a selected orientation. The actuator assembly 125 includes a rod 126 that contacts the bottom surface 122B of the damper plate 121 and an actuator 127 operatively coupled to the rod 126 such that the actuator 127 can move the rod 126 vertically up and down, as shown by arrows 128. The rod 126 can be straight or can be curved and can have a circular cross-section, a rectangular cross-section, or any other suitable shape. The actuator 127 is located outside of the uptake duct 103 while the rod 126 extends through an opening formed through the lower wall 132B and contacts the second end portion 123B with an contacting apparatus 130. In this way, when the actuator 127 moves the rod up and down, the rod 126 moves into and out of the channel 131 and moves the second end portion 123B up and down as well. As a result, the actuator assembly 125 can be used to move the damper plate 121 between different orientations by causing the second end portion 123B to move until the second end portion 132B is positioned at a selected position between the first and second refractory surfaces 133A and 133B and the angle 124 is at a selected value. In some embodiments, the contacting apparatus 130 or the rod 126 are coupled to the second end portion 123B of the damper plate 121. In such embodiments, the first end portion 123A is generally not coupled to any structure so that it may slide freely as the damper plate 121 is moved up or down. In one aspect of this embodiment, the damper plate 121 can include a groove formed in the bottom surface 122B that allows the rod 126 or contacting apparatus 130 to slide along the bottom surface 122B as the damper plate moves between orientations. When the rod 126 or contacting apparatus 130 are coupled with the damper plate 121, the actuator 125 can be configured to lift the damper plate, while relying on gravity to lower the damper plate 121, or the actuator 125 can be configured both lift and lower the damper plate 121. In alternate embodiments, the damper plate 121 can be resting on the rod 126 or contacting apparatus 130 without being actively coupled to the rod or contacting apparatus. In such an embodiment, the first end portion 123A may be pivotably coupled to, for example, the lower wall 132B, or a block 135 may be provided to prevent movement of the first end portion 123A of the damper plate 121 past a specific location.

In some embodiments the rod 126 and the opening in the lower wall 132B are angled with respect to the lower wall 132B to reduce the possibility of the rod 126 pinching against the lower wall 132B as it moves into and out of the opening. To reduce the amount of gas that can leak out of the uptake duct 103 by flowing through the opening in the lower wall 132B, the opening can be sized and shaped to be just slightly larger than the rod 126. In this way, leakage through the opening can be reduced. In some embodiments, insulation can be positioned around the opening to further reduce leakage of gas through the openings and to keep the rod 126 centered within the opening. In other embodiments, the size of the opening is small enough that additional insulation/sealing material is not necessary.

In some embodiments, the actuator 127 can be operated remotely and/or automatically. Further, in some embodiments, the actuator assembly 125 can include a linear position sensor, such as a Linear Variable Differential transformer, that can be used to determine the position of the rod 126, and therefore the orientation of the damper plate 121, and to provide the determined orientation to a central control system. In this way, the uptake damper 120 can be controlled and monitored remotely and a single operator can control the uptake dampers for each of the coke ovens 101 at a coke plant using a central control system. In other embodiments, other position sensors, such as radar can be used instead of, or in addition to the linear position sensor. In still other embodiments, the position sensor can be positioned inside of the actuator 127.

In alternate embodiments to the embodiments shown in FIG. 4, the damper plate 121 can be coupled to the second refractory surface 133B, including with the use of a different connection means than what is shown in FIG. 4. For example, in some embodiments, the damper plate can be coupled to the second refractory surface with a hinge apparatus or with a groove formed in the lower wall 132B.

Regardless of the specific damper type and/or the mechanism used to move the damper to a different orientation, the size of the components of the damper system other than the damper itself are preferably minimized to the greatest extent possible, especially with respect to components that are located within the duct/channel and/or enter into the duct/channel at any point during a change in damper orientation. Minimizing the size of these components can be preferable in order to have lower air in leakage and less cooling of the damper system in the flow path, which minimizes damper system damage and buildup of ash.

During operation of the coke oven 101, the exhaust gases received within the uptake duct 103 are typically in the range of 500° F. to 2800° F. Accordingly, care must be taken when constructing the uptake damper 120 to form the damper plate 121 from a material that retains its shape and structure at these elevated temperatures. In particular, the damper plate 121 can be formed from a refractory material, a ceramic (e.g., alumina, zirconia, silica, etc.), quartz, glass, steel, or stainless steel as long as the selected material holds and remains functional at high temperatures. The damper plate 121 can also include reinforcing material to increase the strength and durability of the damper plate 121. In some embodiments, the damper plate is made from or incorporates a material that is non-brittle at the operating temperatures of the coke oven. In some embodiments, the damper plate is a composite construction, such a damper plate having a base made of a first material and a layer affixed to the base that is made from a second material different from the first material. The layer affixed to the base may be on the face of the base that is contacted by gas and may be glued or otherwise affixed to the base. In an exemplary embodiment, the base is formed from a heavy material such as steel or a fused silica block, and the layer formed on the base is made from a lightweight fiber board or ceramic material. In this configuration, the damper plate has a preferred non-brittle material on the face of the damper plate that contacts the gas while also having sufficient weight and strength. If the damper plate gets stuck in a specific configuration, the embodiment in which a strong base material is provided allows a technician to aggressively handle the damper plate to dislodge the damper plate without damaging the damper plate. The composite damper plate as described above can be made of any number of layers, such as one or more base layers and/or one or more non-brittle layers. In other embodiments, the damper plate can be made entirely from the non-brittle material (i.e., with no underlying base material).

As shown in FIG. 4, the uptake damper 120 can be positioned within the uptake 103 such that the entire damper plate 121 is located within the channel 131 of the uptake duct 103. Thermal gradients within the damper plate 121 can sometimes cause different portions of the damper plate to expand and contract by different amounts and at different rates, which can sometimes lead to cracking of the damper plate. However, because the entire damper plate 121 is located within the channel 131, the entire damper plate 121 is subjected to similar temperatures, which results in the entire damper plate 121 being at a generally uniform temperature and any thermal gradients within the damper plate 121 being reduced. Accordingly, the configuration shown in FIG. 4 can reduce the likelihood of the damper plate cracking due to thermal gradients within the damper plate 121 and can also reduce the potential of ash/slag from building up on the uptake plate 121 since the uptake plate 121 is closer to the actual flue gas temperature.

In the illustrated embodiment, the damper plate 121 is resting on the second refractory surface 133B such that, when the uptake damper 120 is in the completely-open configuration and the angle 124 has a value of approximately 0°, the bottom surface 122B is generally coplanar with the second refractory surface 133B and the top surface 122A is above the second refractory surface 133B. In other embodiments, however, the damper plate 121 can be positioned within the uptake duct 103 such that a portion of the damper plate 121 is below the second refractory surface 133B. For example, in the embodiment shown in FIGS. 5 and 6, the horizontal segment 103C of the uptake duct 103 includes a recess 136 formed in the lower wall 132B and the damper plate 121 is positioned such that the first end portion 123A is disposed within the recess 136 while the rod 126 can extend through an opening formed in the recess to couple to the bottom surface 122B of the damper plate 121. The recess 136 can have a size and shape similar to that of the damper plate 121 such that, when the uptake damper 120 is moved to the completely-open configuration, the damper plate 121 can move downward until both the first and second end portions 123A are positioned within the recess 136. Further, the recess can have a depth substantially equal to a thickness of the damper plate 121 such that, when the uptake damper 120 is in the completely-open configuration, the top surface 122A is generally coplanar with the second refractory surface 133B and the lower surface 122B is below the second refractory surface 133B.

Figure 6:
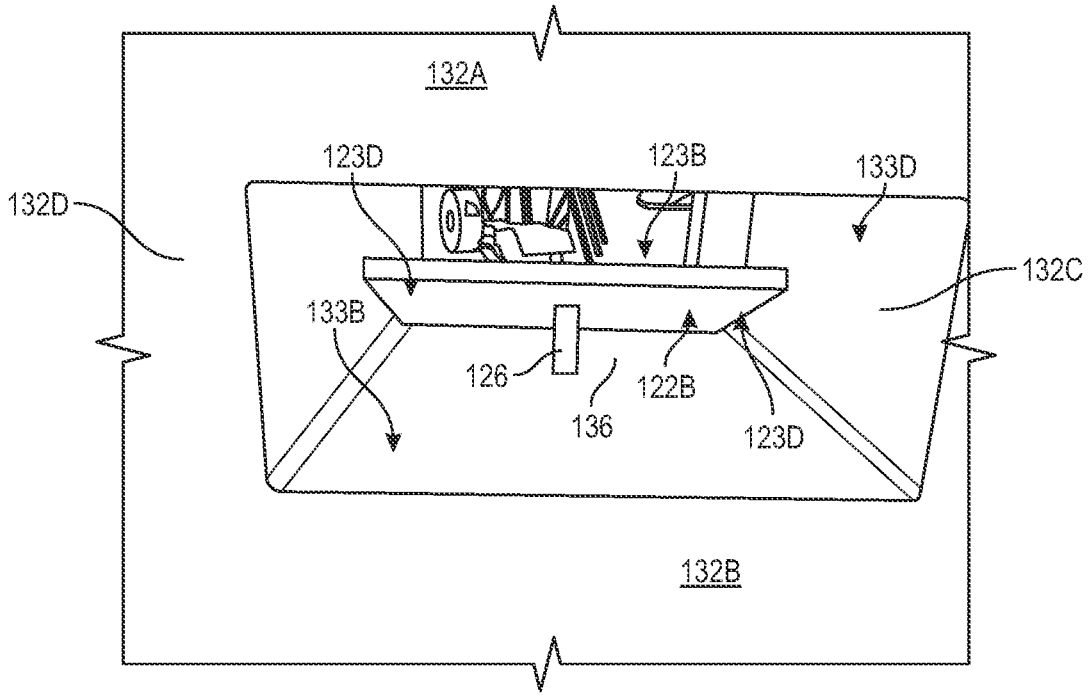

As shown in FIG. 6, a single rod 126 is used raise and lower damper plate 121, with the width of the rod 126 being substantially smaller than the width of the damper plate 121. However, it should be appreciated that configurations can also be provided wherein multiple rods 126 are used to raise and lower the damper plate 121, and/or the width of the rod 126 is substantially larger, including approximately equal to the width of the damper plater 121.

As previously discussed, the damper plate 121 can be sized and shaped such that, when the uptake damper is in the closed configuration, the first and second end portions 123A and 123B can be positioned against the first and second refractory surfaces 133A and 133B. In this way, the damper plate 121 can be sized and shaped to extend between the upper and lower walls 132A and 132B. The damper plate 121 can also be sized and shaped to extend between first and second sidewalls 132C and 132D of the horizontal segment 103C. More specifically, the damper plate 121 has a generally-rectangular shape and can include third and fourth end portions 123C and 123D that are configured to be positioned adjacent to third and fourth refractory surfaces 133C and 133D of the first and second sidewalls 132C and 132D. In this way, when the uptake damper 120 is in the closed configuration, the damper plate 121 can extend across the entire width and height of the channel 131 and can therefore prevent all, or at least most, of the gas within the channel 131 from flowing past the uptake damper 120.

Figure 5:
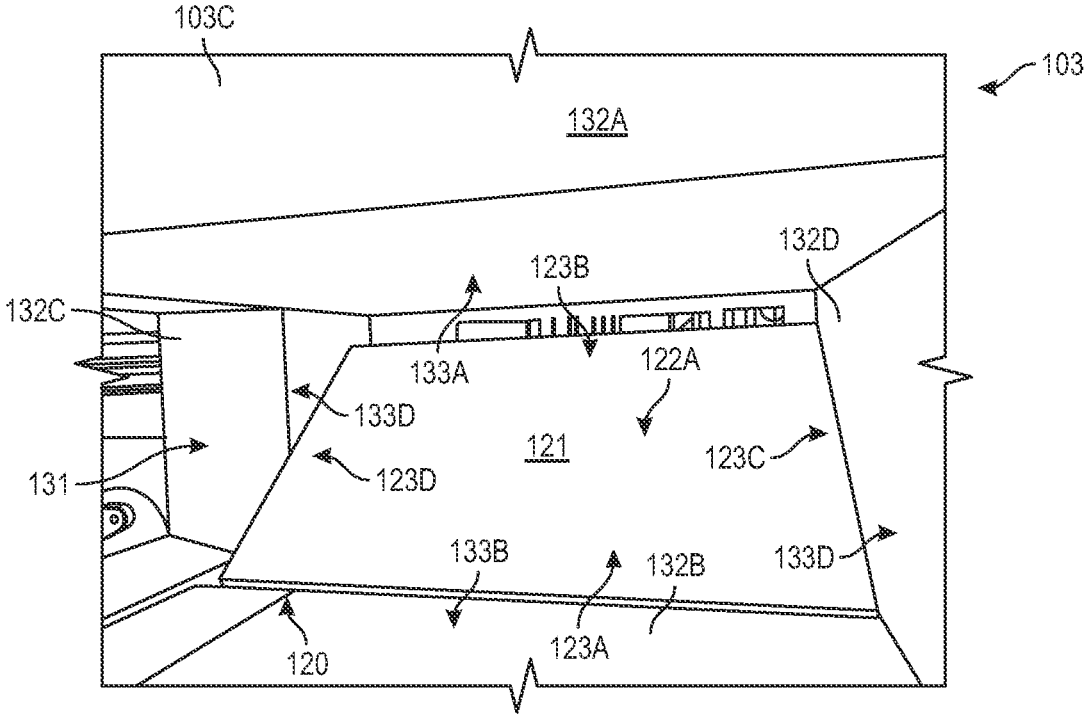
FIGS. 5 and 6 are front and rear isometric views of a damper plate positioned within an uptake duct, in accordance with embodiments of the present technology.
Figure 16:
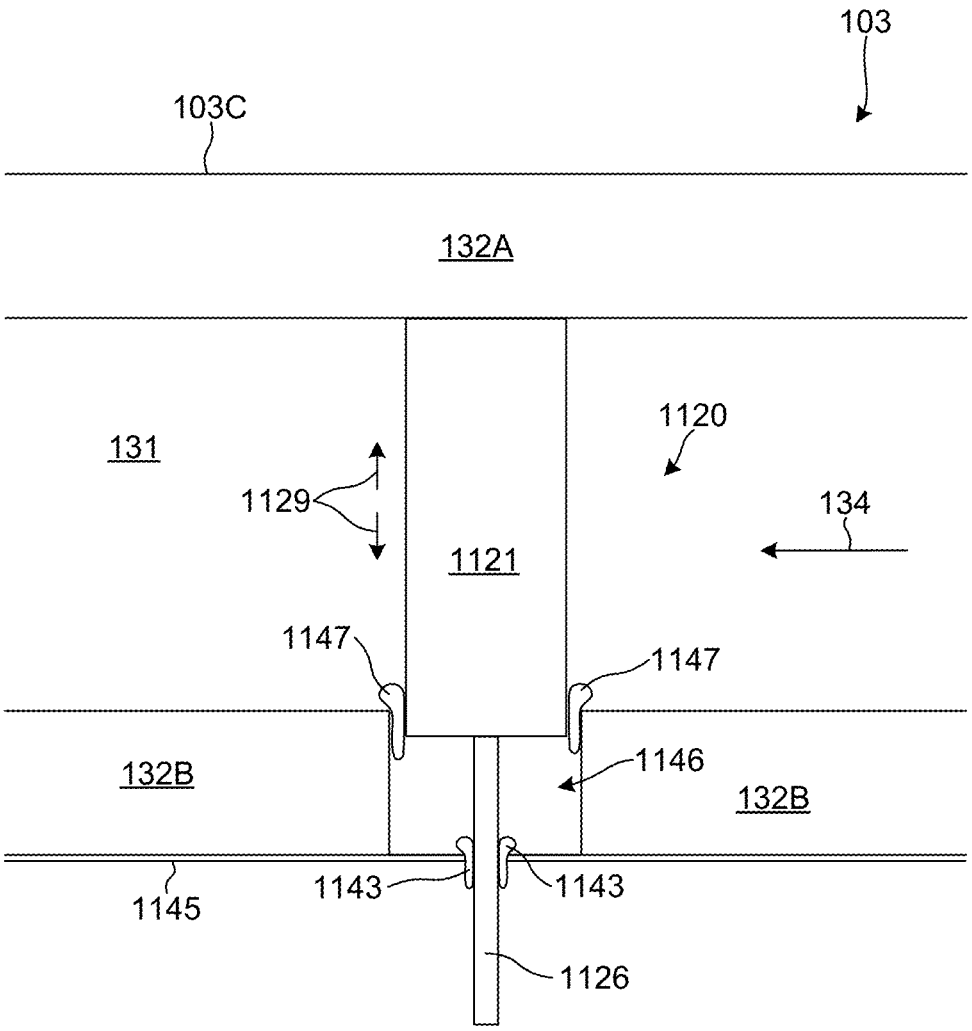
FIG. 16 shows an alternative to the uptake damper system shown in FIG. 15, in accordance with embodiments of the present technology.
Figure 16A:
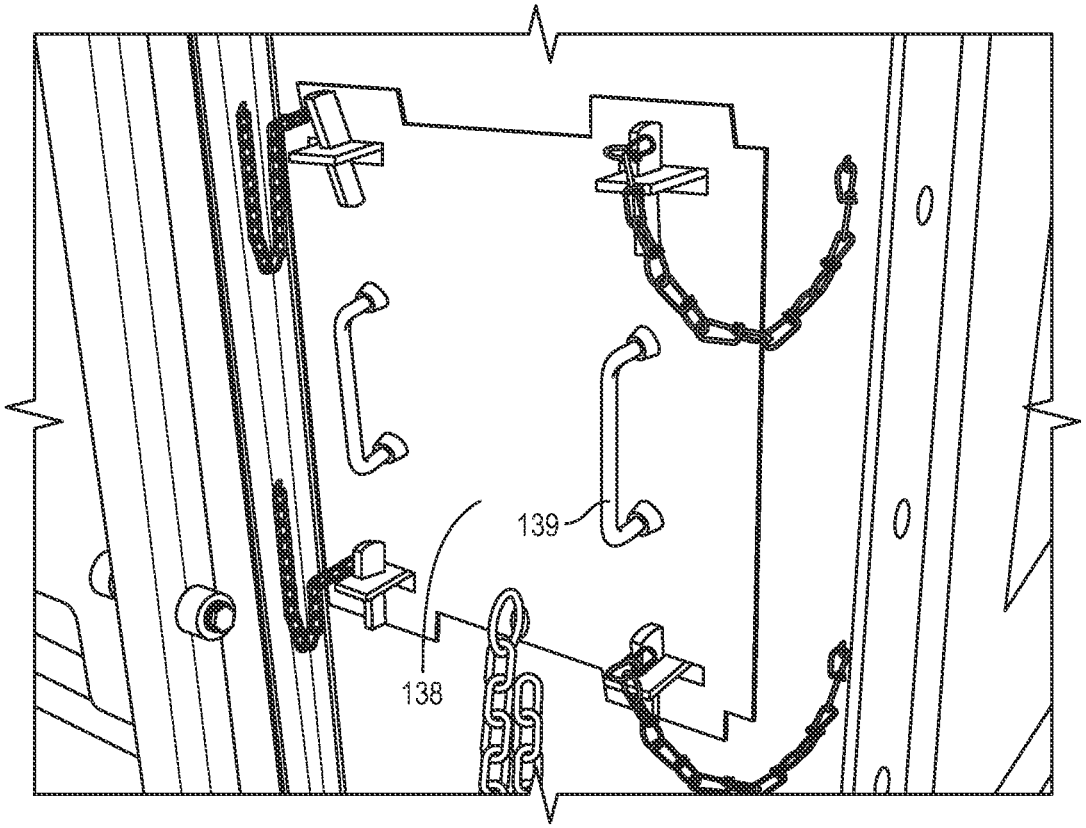
FIGS. 16A and 16B are isometric views of a door provided on an uptake duct, in accordance with embodiments of the present technology.
Figure 16B:
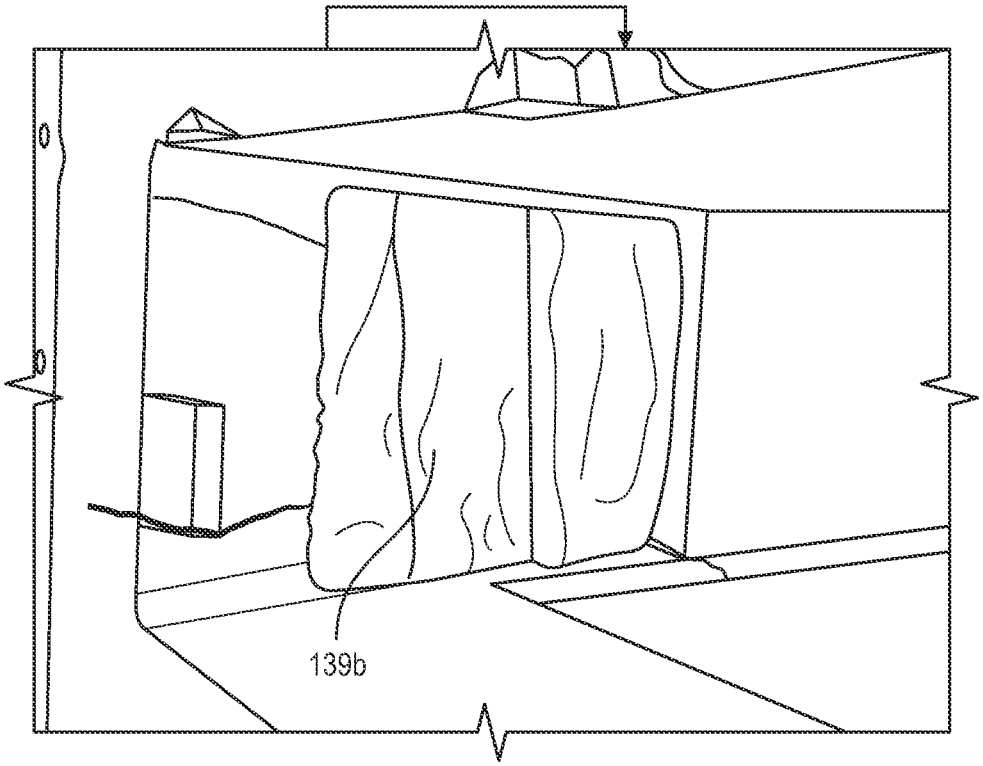

As shown in FIG. 5, the channel 131 can include an opening 137 located proximate the damper plate 121. In FIG. 5, the opening 137 is formed in first sidewall 132C. Opening 137 provides access to the damper plate 121 so that maintenance can be performed on the damper plate 121. With reference to FIGS. 16A and 16B, the opening 137 can include a door 138 that seals off the opening 137 when the uptake duct is in operation. In some embodiments, the door 138 is made from or incorporates lightweight refractory material. The door 138 can be hinged or slide in order to provide access to the damper plate 121, and may also include one or more handles 139 or the like on an external side of the door 138 for ease of opening and closing of the door 138. In some embodiments, a lightweight ceramic fiber 138*b* is filled in the opening 137 on the interior side of the door 138. The lightweight ceramic material 138*b* is easily removed from the opening 137 after the door 138 is opened to thereby provide access to the channel 131.

Figure 7:
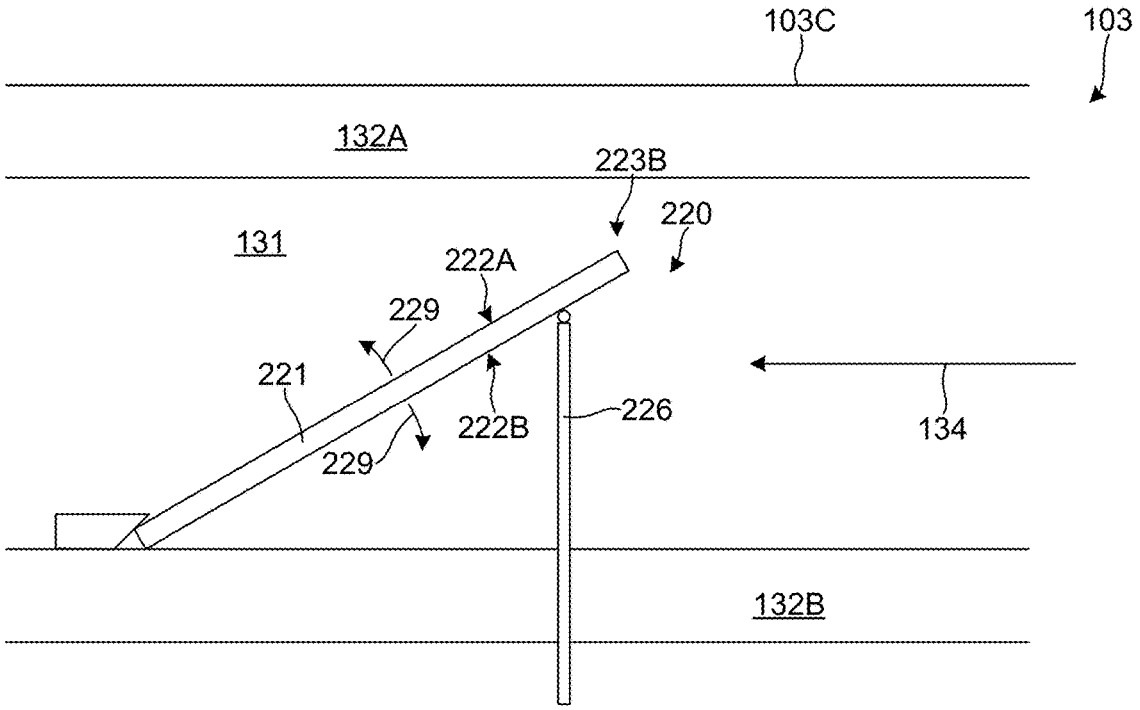
FIG. 7 shows a diagram of an alternative embodiment of the uptake damper system of FIG. 4, in accordance with embodiments of the present technology.

In the previously illustrated embodiments, the uptake damper 120 is positioned and oriented within the channel 131 such that the damper plate 121 is positioned on the second refractory surface 133B and is oriented such that the top surface 122A faces generally toward the exhaust gases flowing in the direction 134 while the bottom surface 122B faces generally away from the gases. In this way, the exhaust gases within the channel 131 tend to impact the top surface 122A and are directed over the second end portion 123B without interacting with the bottom surface 122B. In other embodiments, however, the uptake damper 120 can be differently positioned and oriented within the horizontal segment 103C. For example, FIG. 7 shows a diagram of an alternative implementation of the uptake damper 220. The uptake damper 220 is positioned within the horizontal segment 103C such that the bottom surface 222B of the damper plate 221 faces generally toward the gases flowing through the channel 131 in the direction 134 while the top surface 222A faces generally away from the gases. In this way, the exhaust gases within the channel 131 tend to impact bottom surface 222B and flow over the second end portion 223B without significantly interacting with the top surface 122A. Further, the rod 226 can be used to help move the uptake damper 220 between configurations by causing the damper plate 220 to move towards or away from the lower wall 132B, as shown by arrows 229. While FIG. 7 shows an embodiment where first end portion 223A is free moving (save for block 235 which prevents over-sliding of the damper plate 221) and rod 226 is coupled with second end portion 223B, it should be appreciated that the opposite configuration (first end portion 223A is fixed in place via, e.g., a hinge and second end portion 223B is free moving) can also be used.

Figure 8:
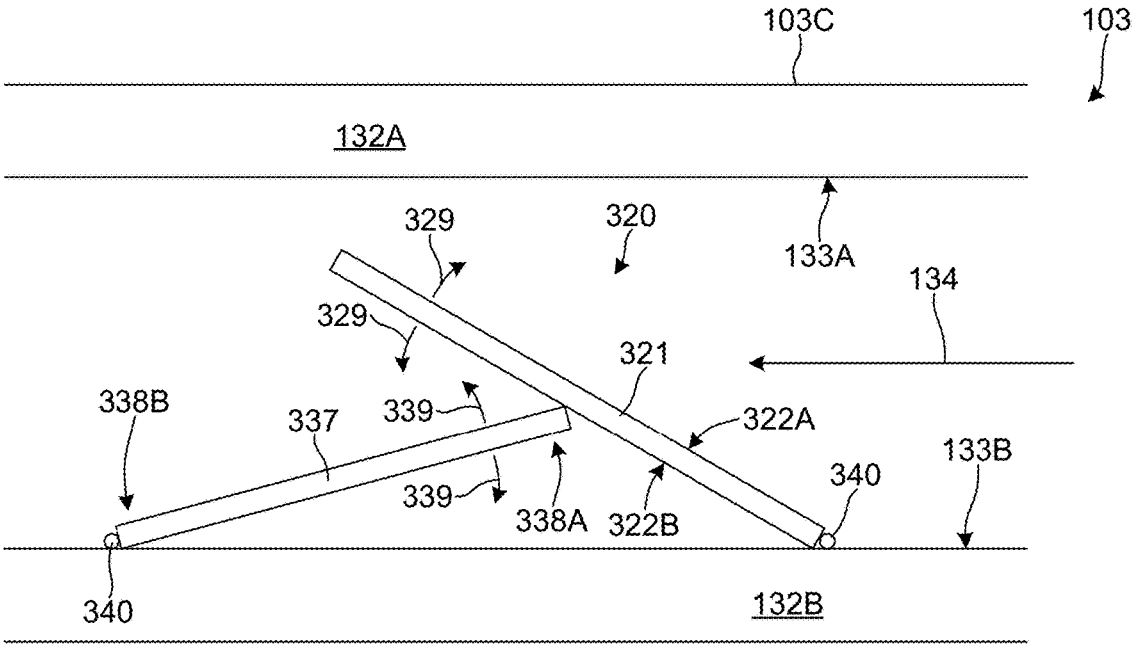
FIG. 8 shows a diagram of an alternative embodiment of the uptake damper system of FIG. 4, in accordance with embodiments of the present technology.

FIG. 8 shows a diagram of an alternative embodiment of the uptake damper 320. The uptake damper 320 includes a damper plate 321 and a control plate 337. The damper plate 321 and the control plate 337 are both coupled to the second refractory surface 133B of the lower wall 132B and are positioned such that the bottom surface 322B of the damper plate 321 faces toward the control plate 337. A first end portion 338A of the control plate 337 is positioned against the bottom surface 322B of the damper plate 322A and a second end portion 338B of the control plate 337 is pivotably coupled to the second refractory surface 132B such that the control plate can be pivoted about the second end portion 338B, as shown by arrows 339. With this arrangement, pivoting the control plate 337 causes the first end portion 338A to slide along the bottom surface 322B of the damper plate 321, which can push the damper plate 321 into a different orientation. Accordingly, the control plate 337 can be used to move the uptake damper 320 into a selected configuration by causing the damper plate 321 to move to a selected orientation. In the illustrated embodiment, the control plate 337 and the damper plate 321 are coupled to the second refractory surface 133B with hinges 340. In other embodiments, however, other types of coupling structures can be used. The control plate 337 can be pivoted via powered hinge 340, or an actuator with rod (not shown) similar to those shown in previous embodiments can be used to raise and lower the control plate 337.

Figure 9:
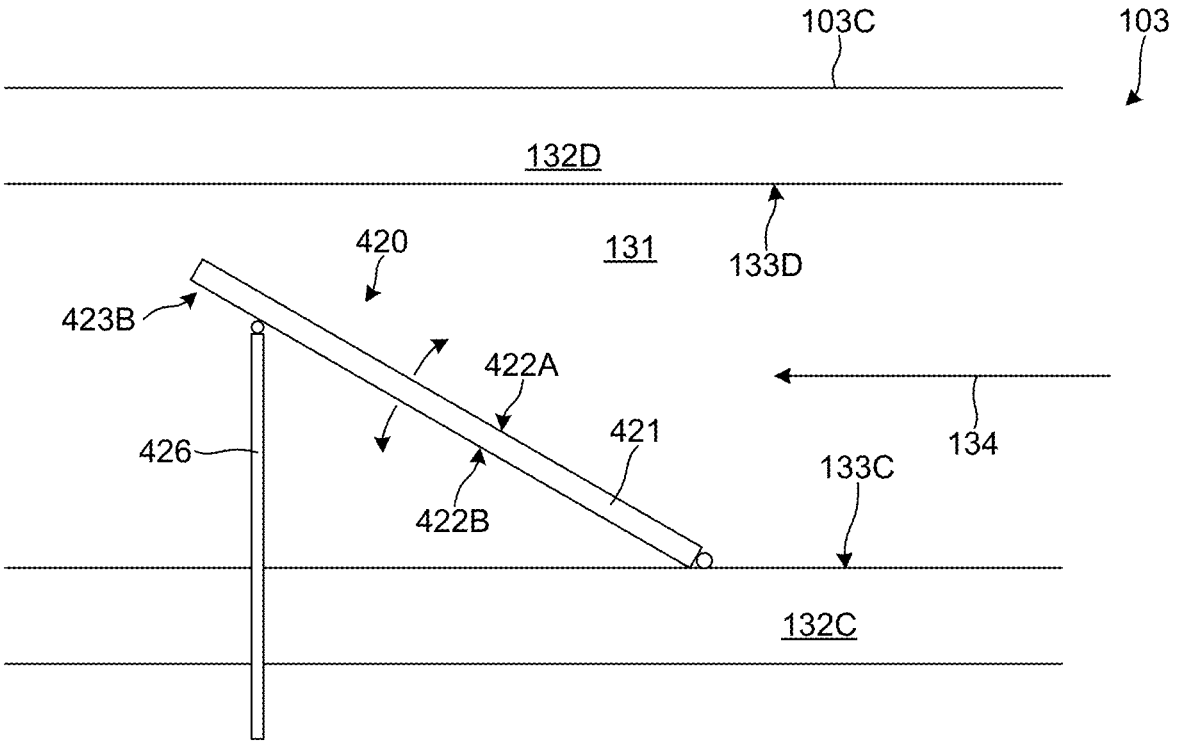
FIG. 9 shows a diagram of an alternative embodiment of the uptake damper system of FIG. 4, in accordance with embodiments of the present technology.

FIG. 9 shows a top-view of another alternative implementation of an uptake damper 420. In embodiments shown in FIGS. 4-8, the uptake damper is positioned on and coupled to the second refractory surface 133B of the lower wall 132B and the actuator assembly is used to move one of the end portion vertically to change the configuration of the uptake damper. In the embodiment shown in FIG. 9, however, the uptake damper 420 is coupled to the third refractory surface 133C of the first sidewall 132C and the rod 426, which is operatively coupled between the second end portion 423B and the actuator 127 shown in FIG. 4, extends through the first sidewall 132C and can be used to move the uptake damper 420 between different configurations by moving the second end portion 423B laterally. In this way, the second end portion 423B can be moved toward or away from the fourth refractory surface 133D of the second sidewall 132D to control the flow of gases through the channel 131 and to regulate the oven draft within the coke oven.

Figure 10:
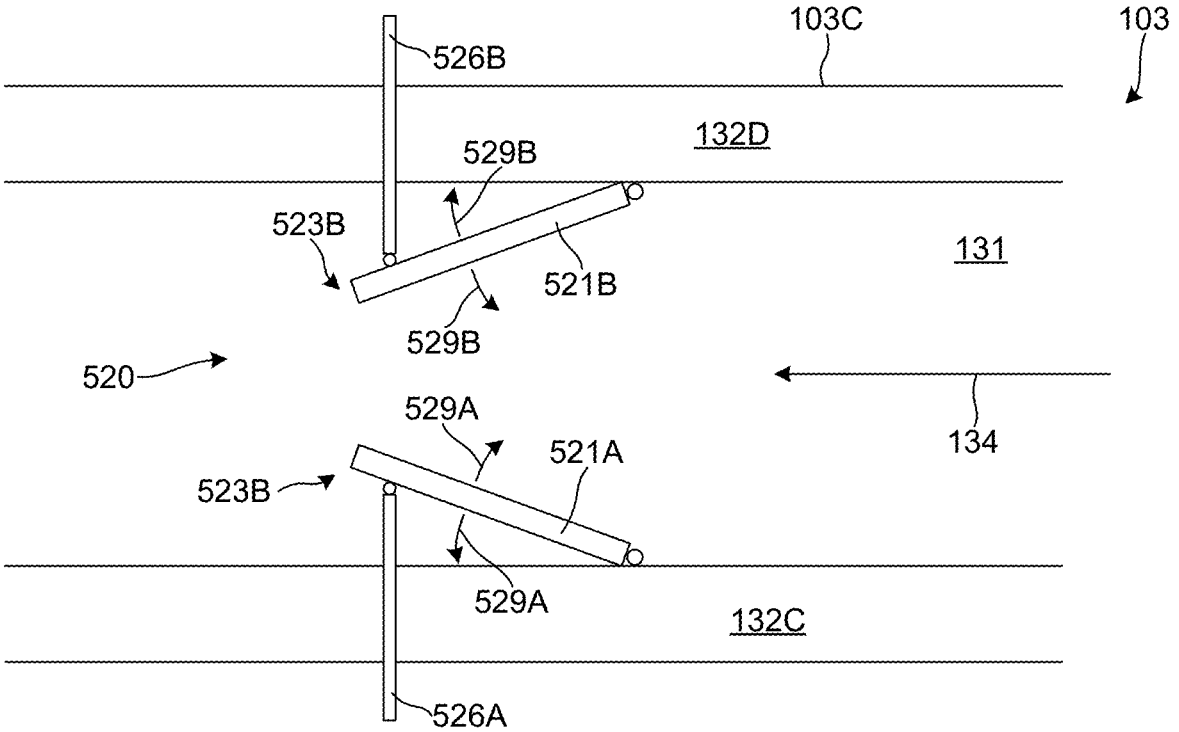
FIG. 10 shows a diagram of an alternative embodiment of the uptake damper system of FIG. 4, in accordance with embodiments of the present technology.

FIG. 10 shows a top-view of another alternative embodiment of an uptake damper 520. The uptake damper 520 can includes first and second damper plate 521A and 521B arranged to have a French-door configuration. The first damper plate 521A is pivotably coupled to the first sidewall 132C and can be rotated relative to the first sidewall 132C using the first rod 526A, as shown by arrows 529A. Similarly, the second damper plate 521B is pivotably coupled to the second sidewall 132D and can be rotated relative to the second sidewall 132D using the second rod 526B, as shown by arrows 529B. With this arrangement, the damper plates 521A and 521B can be rotated independent from each other. Accordingly, to move the uptake damper 520 between different configurations, one or both of the damper plates 521A and 521B can be rotated to different orientations. For example, the uptake damper 520 can be moved to a closed configuration by rotating the first and second damper plates 521A and 521B until the second end portions 5123B of both damper plates 521A and 521B are at a midpoint of the channel 131 and are touching each other. The uptake damper 520 can also be moved to a completely-open configuration by rotating the first and second damper plates 521A and 521*b* until the damper plates are positioned directly against the respective sidewalls 132C and 132D. The uptake damper 520 can also be moved to still other configurations by only moving one of the damper plates 521A and 521B, without moving the other damper plate. In general, the first and second damper plates 521A and 521B can be moved to any suitable orientation that restricts the flow of gases within the channel 131 to a selected flow rate. In the illustrated embodiment, the first and second damper plates 521A and 521B are approximately the same size and positioned adjacent to each other. In other embodiments, however, the first and second damper plates 521A and 521B can have a different size and/or can be positioned offset from each other.

Figure 11:
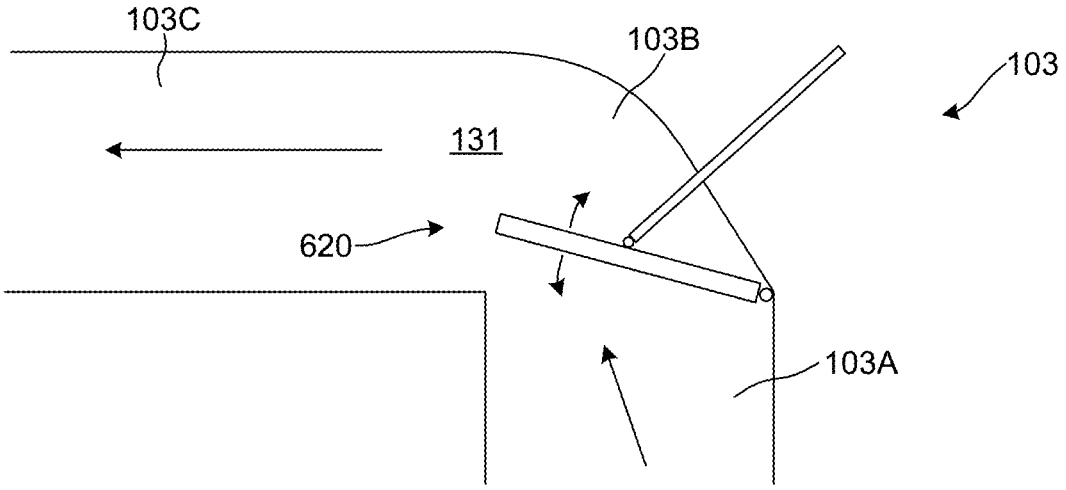
FIG. 11 shows a diagram of an alternative embodiment of the uptake damper system of FIG. 4, in accordance with embodiments of the present technology.

In the embodiments shown in FIGS. 4-10, the uptake dampers are shown as being formed in the horizontal segment 103C of the uptake duct 103. In other embodiments, however, the uptake damper can be incorporated into a different portion of the uptake duct 103. For example, FIG. 11 shows a diagram of an uptake damper 620 formed in the bent segment 103B. With this arrangement, the uptake duct 620 can be used to prevent gases within the vertical segment 103A from reaching the horizontal segment 103C. In still other embodiments, the uptake duct 103 can include multiple of the uptake dampers 620 such that one of the uptake dampers 620 is positioned within the bent segment 103B while a different uptake damper 620 is positioned within the horizontal segment 103C. The uptake dampers 620 can also be used in conjunction with other damper structures, such as a damper plate hanging vertically from the upper wall that can be raised and/or lowered to a selected position within the channel 131.

Figure 12:
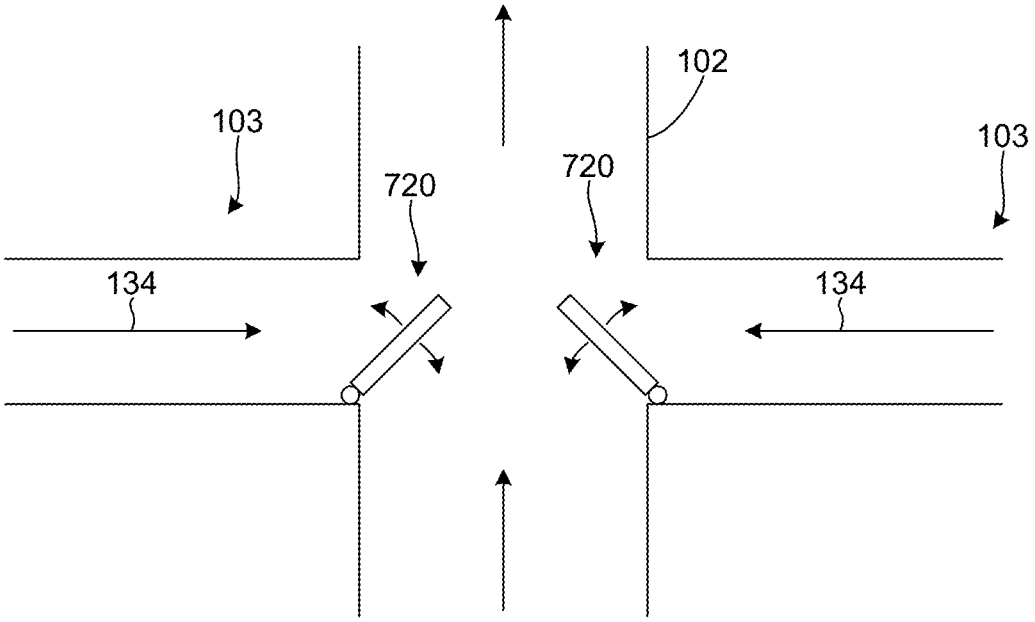
FIG. 12 shows a top diagram of two uptake dampers coupled between two uptake ducts and a common tunnel, in accordance with embodiments of the present technology.

In still other embodiments, the uptake damper can be positioned between the uptake duct 103 and the common tunnel 102. FIG. 12 shows a top-view of the common tunnel 102 and two uptake ducts 103 coupled to the common tunnel 102. In representative embodiments, the two uptake ducts are coupled to the same oven 101 such that the exhaust gas flowing from the two uptake ducts 103 into the common tunnel 102 is from the same uptake oven 101. Both of the update ducts 103 can include an uptake damper 720 coupled between the uptake ducts 103 and the common tunnel 102. The uptake dampers 720 can be configured to swing laterally so as to regulate the amount of exhaust gas that can flow from the uptake duct into the common tunnel 102. Further, when the uptake dampers 720 are in a partially-open configuration, the uptake dampers 720 can act as a deflector that directs exhaust gases leaving the uptake ducts 103 downstream, which can reduce turbulence within the common tunnel 102.

In each of the previously illustrated embodiments, the damper plates of the uptake dampers are controlled movable using a rod that extends through a wall of the uptake duct and couples to the damper plate. In other embodiments, however, the damper plates can be controlled using other movement systems. For example, in some embodiments, a wire or cable that extends through an opposing sidewall can be used to pull the damper plate to a selected orientation. In some embodiments, the wire or cable can be coupled to a pivot pin coupled to the end portion of the damper plate. In other embodiments, the damper plate can be coupled to an electric or magnetic hinge that can rotate the damper plate to the selected rotation. In general, any suitable movement system capable of withstanding elevated temperatures can be used to move the damper plate to a selected orientation.

Figure 13B:
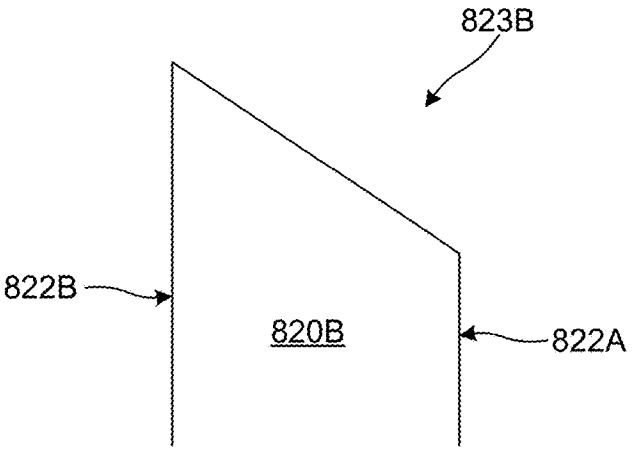
FIGS. 13A-C show alternative embodiments of end portions of the damper plates shown in FIGS. 4-12, in accordance with embodiments of the present technology.
Figure 13A:
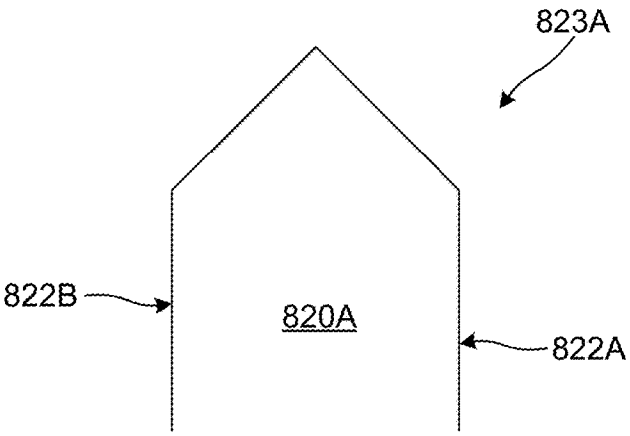
Figure 13C:
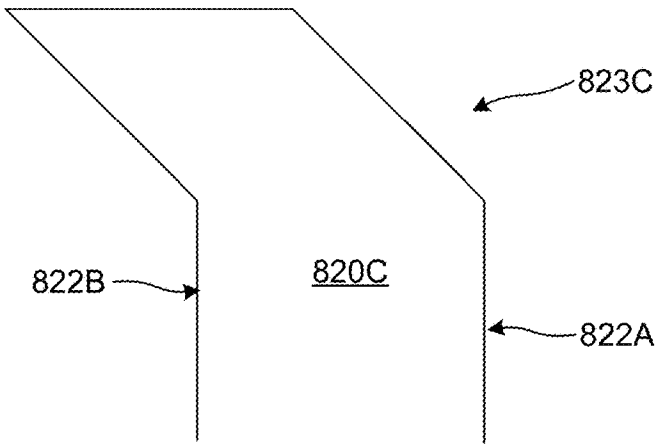

In each of the previously illustrated embodiments, the damper plates for each of the uptake dampers have been depicted as being flat and rectangular plates and having a rectangular edge portions. In other embodiments, however, the damper plates can have a different shape. For example, the damper plates can be curved, angled, or any other suitable shape that provides good mating with walls of the channel 103. In still other embodiments, edge portions of the damper plates can be shaped to reduce recirculation of exhaust gases and minimize ash build up on the back of the plate as the exhaust gases flow past the damper plates. FIGS. 13A-C show examples of differently-shaped edge portions 823. Specifically, FIG. 13A shows a side elevation view of an edge portion 823A having a pointed shape, FIG. 13B shows a side elevation view of an edge portion 823B having a sloped shape, and FIG. 13C shows a side elevation view of an edge portion 823C having a swept shape. Each of these shapes can allow exhaust gases to more efficiently flow past the edge portions 823A-C, which can improve the operation of the uptake ducts and uptake dampers.

Figure 14A:
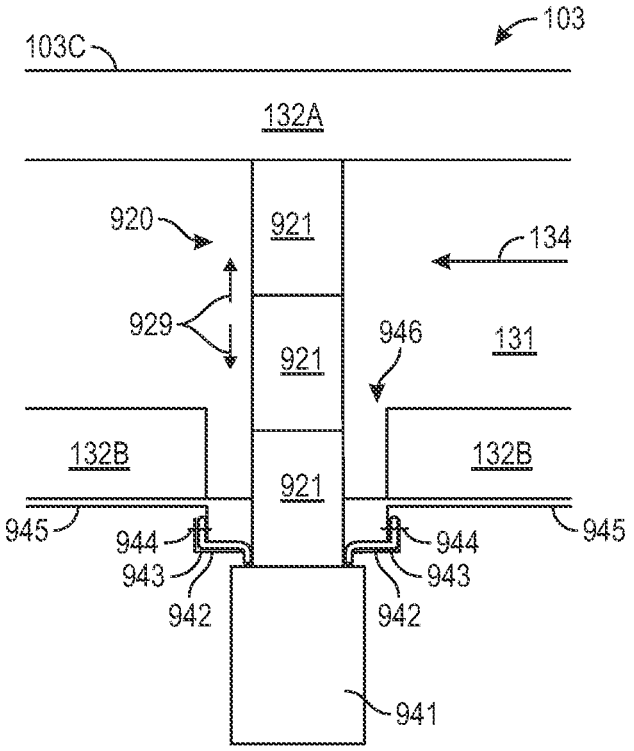
FIGS. 14A-B show an alternative to the uptake damper system shown in FIGS. 4-12, in accordance with embodiments of the present technology.
Figure 14B:
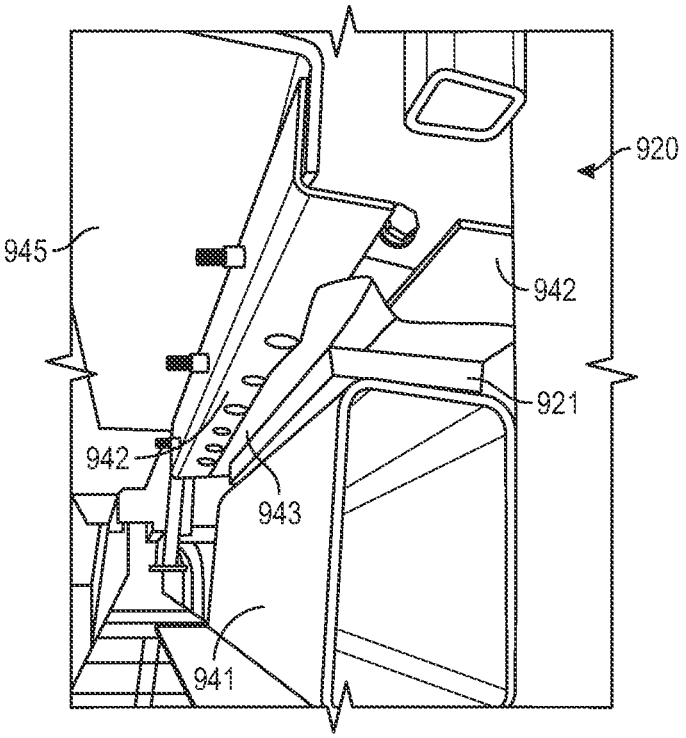

In the previously illustrated embodiments, the uptake damper is shown as including a plate structure that can be moved into a selected position and orientation by pivoting the plate structure. In other embodiments, however, the uptake damper can include one or more blocks that can be moved into a selected position by linearly moving into and out of the channel 131. For example, FIGS. 14A and 14B show an uptake damper 920 that includes three damper blocks 921 stacked together and configured to be moved vertically into and out of the channel 131, as shown by arrows 929. The damper blocks 921 are stacked together and positioned in an opening 946 formed through the lower wall 946 of the horizontal segment 103C and positioned on a piece of square piping 941 located outside of the uptake duct 103. An actuator coupled to the piping 941 can be used to raise and lower the damper blocks 921 to a selected height within the channel 131. In some embodiments, the weight of the damper blocks 921 can be used to lower the uptake damper while the actuator is used to raise the uptake damper. In other embodiments, the actuator is used to both raise and lower the uptake damper. However, the opening 946 can sometimes allow hot gases within the channel 131 to leak out of the uptake duct 103 even if the uptake damper 920 is in a closed configuration, which can result in heat and pressure being undesirably lost from the coke oven. To reduce the amount of gas and heat that can escape from the uptake duct 103 via the opening 946, the uptake damper 920 can include insulation that helps to at least partially seal the opening 946. The uptake duct 103 includes a metal plate 945 that forms an outer surface for the uptake duct 103. The uptake damper 920 can include an L-shaped bracket 942 that is positioned adjacent to a portion of the metal plate 945 and that extends around the opening 946 and the damper block 921. Insulation 943 is positioned such that a first portion of the insulation 943 is sandwiched between the metal plate 945 and the bracket 942 while a second portion of the insulation 943 extends toward the damper block 921 and even extends past the bracket 942. Securing mechanisms, such as bolts 944, can be used to securely couple the metal plate 945, the insulation 943, and the bracket 942 together to hold the insulation 943 in place. With this configuration, the insulation 943 can reduce the amount of exhaust and heat than can pass escape from the uptake duct 103 via the opening 946. However, this arrangement of the insulation 943, the bracket 942, bolts 944, and metal plate 945 is only an example. In other embodiments, the bracket 942 can be a flat plate and wing nuts can be used to adjust the seal. In still other embodiments, other seal designs and configurations can be used. For example, in some embodiments, the seal can be mechanically actuated such that it is pressed against the damper blocks 921 to affect a better seal when the uptake duct is in use. Correspondingly, when the damper blocks 921 are being moved into or out of the channel 131, the seal can be mechanically actuated so that it is released from the pressing against the damper blocks 921.

In some embodiments, the insulation 943 can include Kaowool. The Kaowool can be formed into a tad-pole seal having a bulb portion and a tail portion and the insulation 943 can be positioned such that the bolt 944 extends through the tail portion while the bulb portion is positioned between the bracket 942 and the damper block 921. In this way, the insulation 943 can help to seal off the opening 946. In other embodiments, however, the insulation can include other materials, such as woven cloth formed from ceramic fibers or a bristle brush material, and can have a different shape. In general, the insulation 943 can be formed from any suitable material, or combination of materials, and can have any suitable shape that allows the insulation 943 to at least partially seal the opening 946 while also withstanding the high temperatures present within the channel 131.

Figure 15:
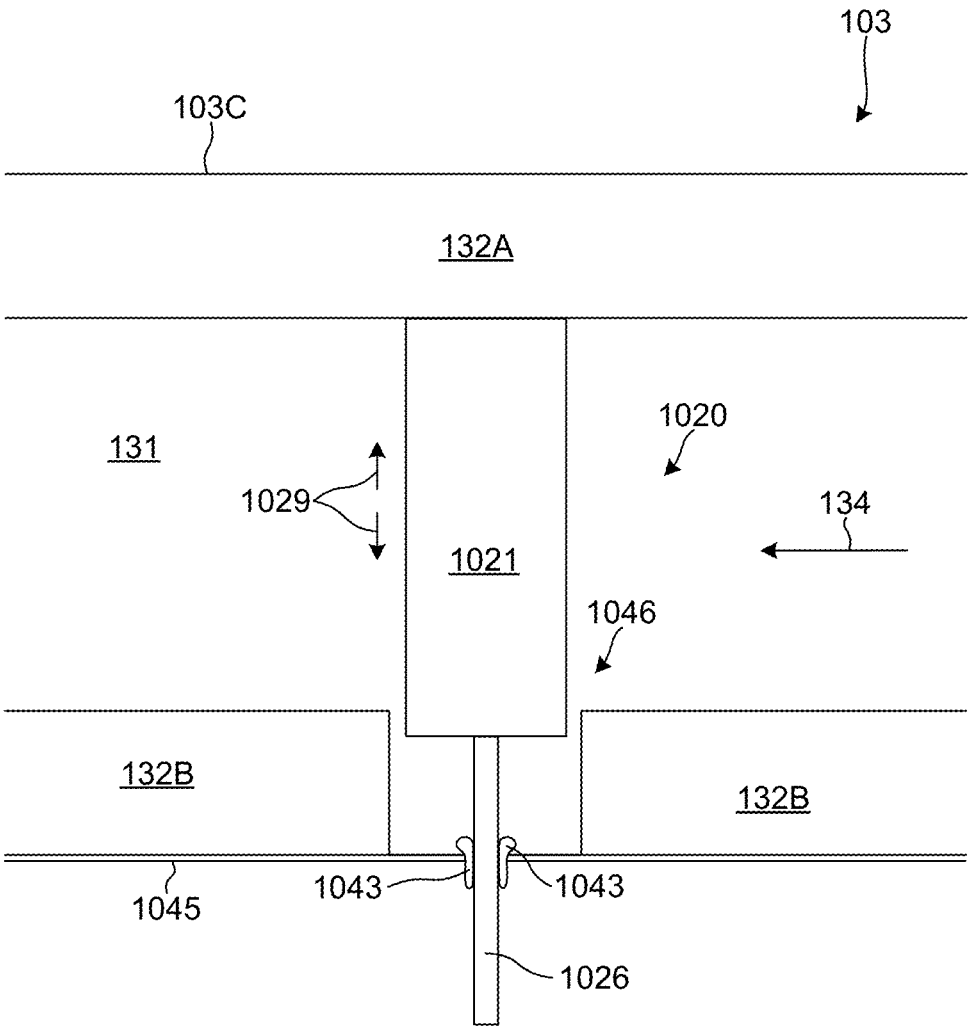
FIG. 15 shows an alternative to the uptake damper system shown in FIGS. 4-12, in accordance with embodiments of the present technology.

FIG. 15 shows an alternative uptake damper to the structure shown in FIGS. 14A and 14B. In the embodiment shown in FIG. 15, the uptake damper 1020 includes a single damper block 1021 that is positioned entirely within the uptake duct 103. The damper plate 1021 can be sized and shaped to extend across the entire height of the channel 131 and is supported by one or more rods 1026. The one or more rods 1026 extend through the opening 1046 formed in the lower wall 132B and through plate 1045 and is coupled to an actuator that can be used to move the damper block 1021 vertically, as shown by arrows 1029. The actuator used to move the damper block 1021 can be capable of raising the damper block 1021 while relying on gravity to lower the damper block 1021, or can be capable of both raising and lowering the damper block 1021. In some embodiments, the plate 1045 is formed from metal. In other embodiments, however, the plate 1045 is formed from cast refractory block that is coupled to the lower wall 132B. To reduce the amount of gas and heat that can escape from the uptake duct 103 by passing through the opening 1046 and through the opening in the plate 1045, the uptake damper 1020 can include insulation 1043 that is positioned around the rod 1026. In some embodiments, a seal is provided around the rod 1026, such as a mechanically actuatable seal. When a mechanically actuated seal is used, the seal can be actuated to press more firmly against the rid 1026 when the uptake duct is in use. Correspondingly, the seal can be actuated to release from against the rod when the damper block 1021 is being moved into or out of the channel 131. Because the rods 1026 typically have smaller dimensions than the uptake block 1021, the size of the openings formed in the plate 1045 can be reduced, thus reducing the amount of space that gas can leak out of the duct 103 and reducing the amount of insulation 1043 (or the size of the seal) needed to sufficiently seal the opening.

While FIG. 15 illustrates a configuration using a single rod 1026 to raise and lower the damper block 1021, more than one rod can also be provided. In some embodiments, the damper block 1021 includes in its lower surface (i.e., the surface facing the lower wall 132B) a recess into which the rod 1026 can extend in order to couple together the rod 1026 and the damper block 1021. In some embodiments, the rod 1026 may be positively coupled with the damper block 1021, such as through the use of a material that is filled into the recess and hardens after the rod 1026 is inserted in the recess in the damper block 1021 (e.g., a cement-type material). In other embodiments, the rod 1026 is inserted in the recesses in the block 1021, but is otherwise not connected to the block 1021.

In some embodiments, the uptake damper can also include other insulation positioned within the opening and that can be used to restrict and/or prevent exhaust from passing by the uptake damper by passing under the damper block when the uptake damper 1020 is in a closed configuration. For example, FIG. 16 shows an alternative uptake damper to the 1120 to the structure shown in FIG. 15. The uptake damper 1120 includes insulation 1147 positioned around the opening 1146 and that is positioned between the damper block 1121 and the lower wall 132B. The insulation 1147 acts as a barrier that limits and/or prevents gas within the channel 131 from bypassing the uptake damper 1120 by passing into the opening 1146 and flowing under the damper block 1121. In some embodiments, the insulation 1147 can be a tad-pole seal.

Figure 17:
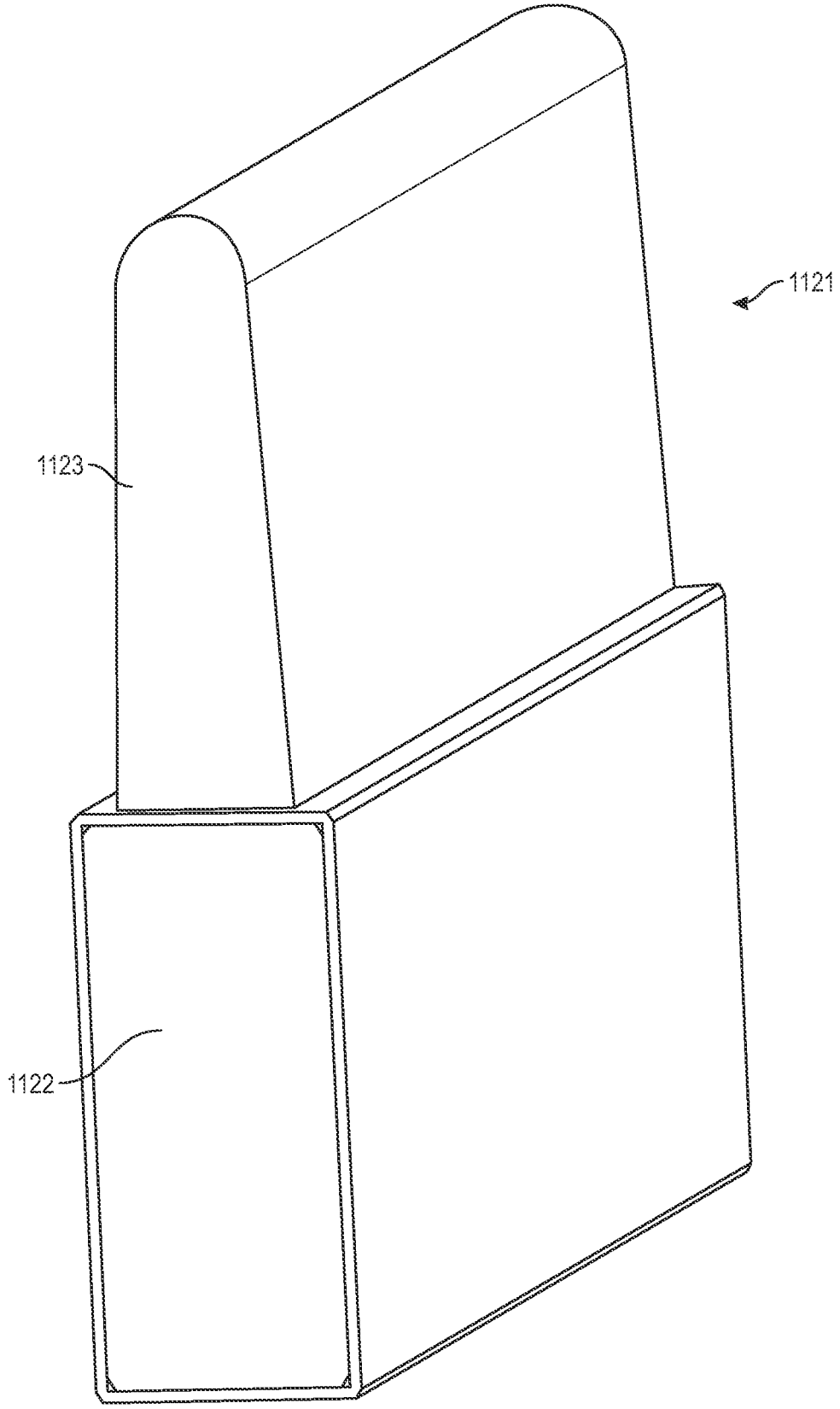
FIG. 17 is an isometric view of a uptake damper in accordance with embodiments of the present technology.

FIG. 17 shows still another alternate embodiment to the damper blocks shown in FIGS. 14A-15. The damper block 1121 shown in FIG. 17 generally includes a box 1122 that serves as the base of the damper block 1121 and a block 1123 disposed on top of the box 1122. As with previous damper block embodiments, the damper block 1121 may be raised and/or lowered using one or more rods that contact the box 1122. In some embodiments, the bottom surface of the box 1122 includes a recess for each rod used to lower and/or raise the damper block 1121. The rod extends into the recess and can be positively connected to box 1122, or can reside within the recess without any additional means for connecting the rod to the box 1122. In some embodiments, the box 1122 is made from a metal material. In some embodiments, the block 1123 may be made from a refractory material. The block 1123 may be bolted or otherwise secured to the box 1122. In some embodiments, the damper block 1121 is dimensioned and installed in such a way that the box 1122 never enters the channel of the uptake duct. In other words, when the damper block 1121 is fully raised, the box 1122 remains outside of the channel of the uptake duct while the block 1123 is fully within the channel extends across the height of the channel. As with previous embodiments, insulation material and/or seals can be used to prevent gas and/or heat from escaping the uptake duct where the damper block 1121 extends into the channel. In some embodiments, a fiber insulation material is provided disposed in the gap in the uptake duct through which the damper block 1121 extends. In some embodiments, this fiber insulation will surround the box 1122 to prevent loss of heat and/or gas. In an alternate embodiment, the material of the block 1123 is a fiber board material, which is lightweight material compared to the refractory material that can be used for the block 1123. An exemplary, fiberboard material suitable for use as the block 1123 is Fibermax® Duraboard 1700 or Fibermax® Duraboard 1800, manufactured by Unifrax of Niagra Falls, N.Y.

Referring back to FIG. 3 and the general configuration wherein an uptake duct 103 is aligned orthogonally with the common tunnel 102, it is generally understood that under this configuration the flow of exhaust gas from the uptake duct 103 to the common tunnel 102 will include an approximately 90 degree turn when the exhaust gas transitions from the uptake duct 103 into the common tunnel 102. Accordingly, in some embodiments, an uptake damper system is provided that is configured to both control the amount of exhaust gas flowing through the uptake duct 103 and into the common tunnel 102 and the direction of the flow exhaust gas as it transitions form the uptake duct 103 to the common tunnel 102.

Figure 18A:
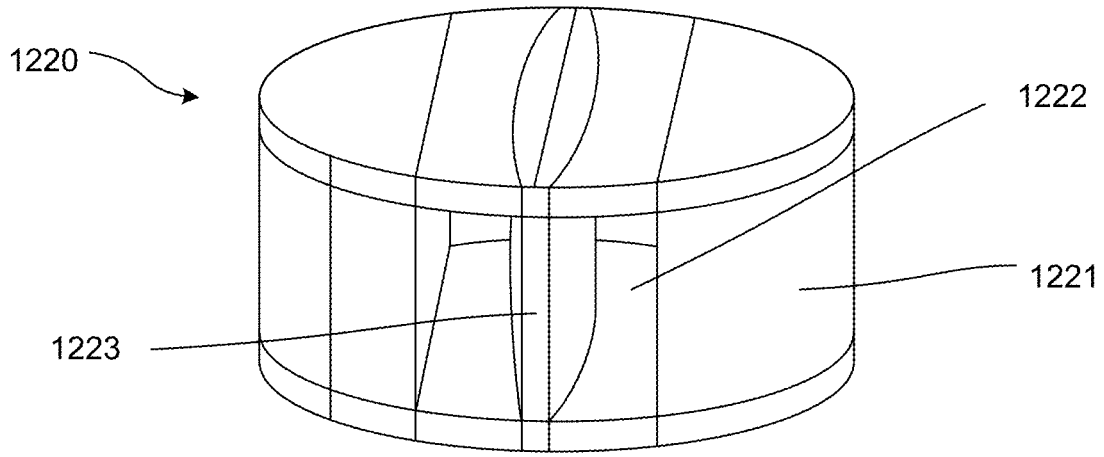
FIGS. 18A and 18B are isometric views of an uptake damper in accordance with embodiments of the present technology.
Figure 18B:
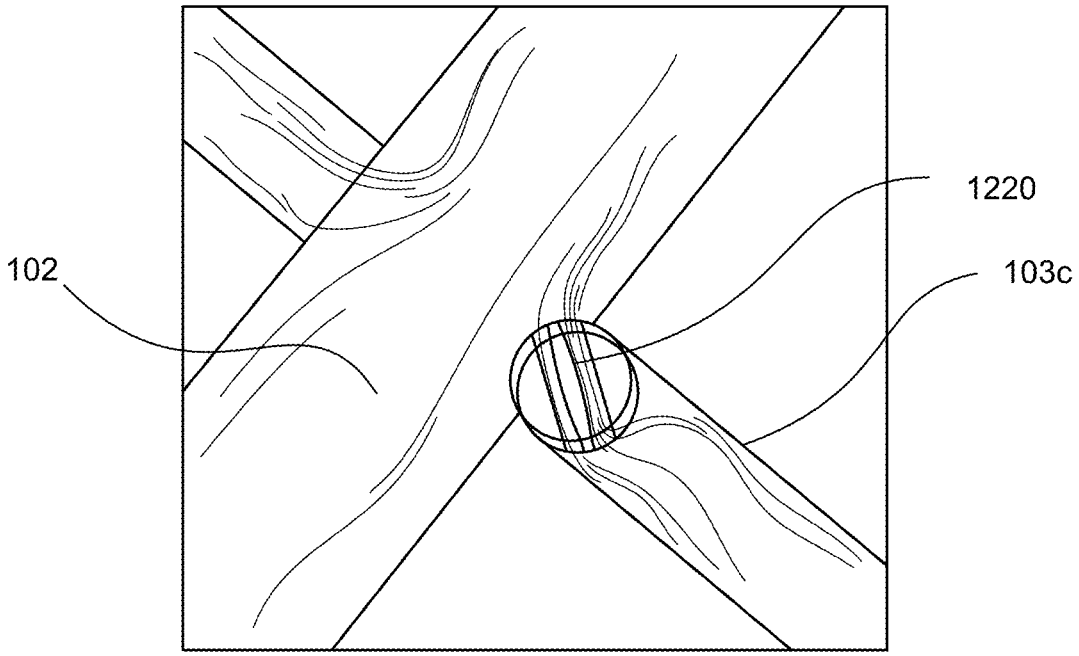

FIGS. 18A and 18B provide an illustration of an embodiment of an uptake damper 1220 configured to control exhaust gas flow and direction. The uptake damper 1220 generally comprises a cylinder 1221 having a passage 1222 extending through the cylinder 1221. The cylinder 1221 is fully rotatable such that the passage 1222 can be oriented in any direction. For example, in some embodiments, the cylinder 1221 is oriented such that the passage 1222 is aligned in parallel with the longitudinal axis of the horizontal segment 103*c* of the uptake duct 103. In such a configuration, exhaust gas passing through the passage 1222 (i.e., from the uptake duct 103 into the common tunnel 102) will enter the common tunnel at a direction generally orthogonal to the flow of exhaust gas travelling through the common tunnel. However, when the cylinder 1221 is rotated such that the passage 1222 is oriented, e.g., at a 45 degree angle to the longitudinal axis of the horizontal segment 103*c* of the uptake duct, gas passing through the passage 1222 will arrive into the common tunnel at a 45 degree angle to the gas flowing through the common tunnel, which can allow for improved integration between gas already in the common tunnel 102 and gas entering the common tunnel 102 via an uptake duct 103. FIG. 18B illustrates the scenario in which the cylinder 1221 of the uptake damper 1220 is rotated such that the passage 1222 is oriented at a 45 degree angle. As shown in FIG. 18B, gas flowing through the horizontal segment 103*c* merges towards the left side of the horizontal segment 103*c* so that it can enter the passage 1222, whose opening is positioned closer to the left side of the horizontal segment 103*c* due to the 45 degree orientation. The gas then flows through the passage 1222 and exits into the common tunnel 102 at an angle approximately equal to the angle of the passage 1222. Because the gas enters the common tunnel 102 at an angle that is closer to the direction of flow of gas through the common tunnel 102, the gas is able to better integrate with the gas already flowing through the common tunnel 102.

As shown in FIG. 18B, the uptake damper 1220 is positioned at the terminal end of the horizontal segment 103*c* of the uptake duct 103. That is to say, the uptake damper 1220 is positioned so that it is effectively located at the junction point between the horizontal segment 103*c* of the uptake duct 103 and the common tunnel 102. In fact, in some embodiments, a portion of the uptake damper 1220 may be positioned within the common tunnel 102. This helps to ensure that gas exiting the passage 1222 of the uptake damper 1220 enters into the common tunnel 102 and merges with the gas in the common tunnel 102 at the angle at which the passage 1222 is oriented.

As noted above, the uptake damper 1220 can be rotated so that the passage 1222 is oriented in any desired direction. Provided that the openings of the passage 1222 are still able to receive gas from the uptake duct 103 and expel gas into the common tunnel 102, the angle of orientation can be lowered below, e.g., 45 degrees to attempt to provide an even smoother integration between the gas passing through the uptake damper 1220 and the gas already travelling through the common tunnel 102. In some embodiments, as the cylinder 1221 is rotated such that the openings of the passage 1222 become blocked, the uptake damper 1220 can also be used to control the amount of flow through the uptake damper 1220. Further still, when the cylinder 1221 is rotated such that the openings of the passage 1222 are fully blocked (e.g., wherein the passage 1222 is at a 90 degree angle to the longitudinal axis of the horizontal segment 103*c* of the uptake duct 103, the uptake damper 1220 can fully prevent flow of gas from the uptake duct 103 to the common tunnel 102.

FIG. 18A illustrates an embodiment of the uptake damper 1220 where a partition 1223 is disposed within the passage 1222 in a direction parallel to passage 1222. The partition 1223 can generally extend the length of the passage 1222. The partition 1223 can have any thickness, but will generally have a relatively small profile so as to not overly impede flow of gas through the passage 1222. The partition 1223 shown in FIG. 18A has a thickness that increases from a first end to the middle of the partition 1223, before decreasing from the middle of the partition 1223 to a second end of the partition 1223 to thereby form a generally "cat's eye" shape when viewed from above. However, it should be appreciated that any shape partition can be used. For example, in some embodiments, the partition 1223 can be curved so as to further aid changing the direction of the gas flowing through the uptake damper 1220.

While FIG. 18A illustrates an uptake damper 1220 that includes partition 1223, it should be appreciated that the uptake damper 1220 can also be used without a partition 1223, such that the passage 1222 is free of any obstructions. FIG. 18A also generally illustrates a straight line passage 1222 having a uniform width, though it should be appreciated that the passage 1222 could be curved and/or having a varying width along its length.

Any manner of rotating the uptake damper 1220 can be used. In some embodiments, a rod is attached to the bottom or top surface of the cylinder 1221, and the rod can be rotated in order to rotate the cylinder 1220. The rod preferably does not extend into the passage 1222 of the cylinder 1221 so as not provide an obstruction within the passage 1222.

Figure 19A:
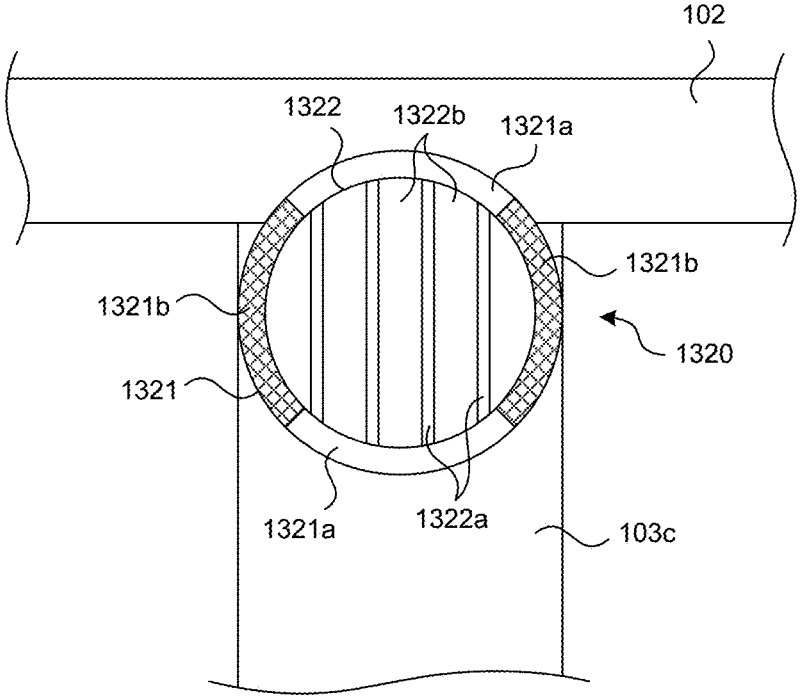
FIGS. 19A-19D shows a top diagram of uptake damper systems in accordance with embodiments of the present technology.
Figure 19B:
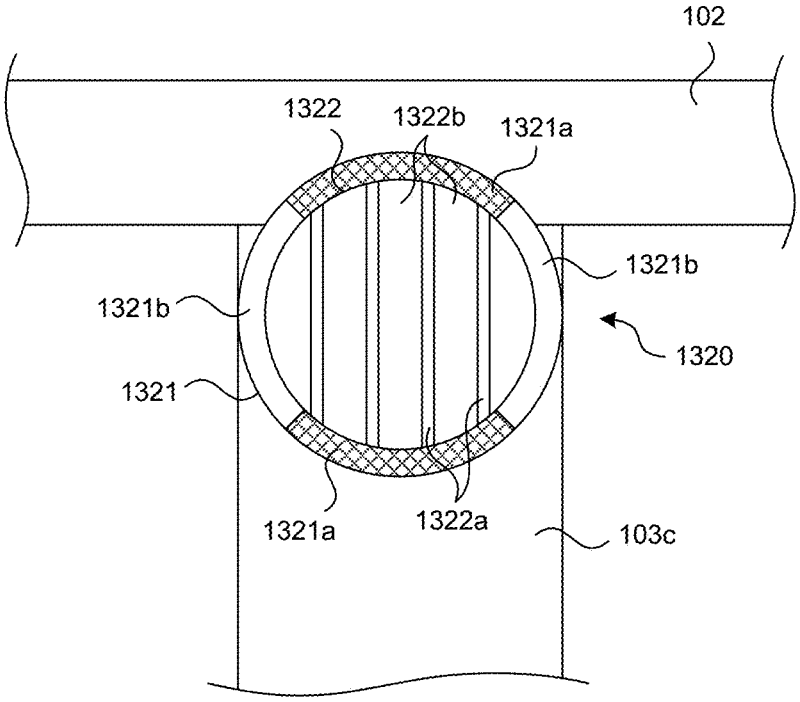

FIGS. 19A-19D illustrate an alternate embodiment of the uptake damper 1220 shown in FIGS. 18A and 18B in which two concentric cylinders are used to form uptake damper 1320. As shown in FIG. 19, which is a top down view of the uptake damper 1320 positioned at the terminal end of a horizontal segment 103*c* of an uptake damper (i.e., at the junction between the horizontal segment 103 and the common tunnel 102), the uptake damper 1320 comprises an outer cylinder 1321 and an inner cylinder 1322 concentrically aligned with the outer cylinder 1321. The outer cylinder 1321 has a hollow interior region into which the inner cylinder 1322 is disposed. As such, the outer cylinder 1321 has an outer diameter and an inner diameter, with the inner diameter defining the size of the hollow interior region. In this configuration, the outer cylinder 1321 effectively forms a rotatable shell around the inner cylinder 1322. The outer cylinder has two openings 1321*a* opposite each other and two side walls 1321*b* opposite each other. The openings 1321*a* and the side walls 1321*b* extend the height of the outer cylinder 1321, with the openings 1321*a* providing passage into and out of the inner cylinder 1322 and the side walls 1321*b* serving to block off the inner cylinder 1322, depending on the rotation of the outer cylinder 1321. For example, as shown in FIG. 19A, when the openings 1321*a* in outer cylinder 1321 are positioned to be upstream and downstream of the inner cylinder 1322, gas flowing through the horizontal segment 103*c* towards the common tunnel 102 can flow into and through the inner cylinder 1322. FIG. 19B, on the other hand, shows an embodiment where the outer cylinder 1321 has been rotated 45 degrees such that the sidewalls 1321*b* are positioned downstream and upstream of the inner cylinder 1322. In this configuration, the sidewalls block gas flowing into and through the inner cylinder 1322. Thus, by rotating the outer cylinder 1321 to the desired position, the flow of gas through the inner cylinder 1322 can be allowed or prohibited. The outer cylinder 1321 can also be positioned to allow limited flow into the inner cylinder 1322, such as when the sidewalls 1321*b* are positioned to partially but not fully block the inner cylinder 1322.

The inner cylinder 1322 has an outer diameter that is approximately equal to the inner diameter of the outer cylinder 1321 so that the inner cylinder 1322 can be disposed within the hollow interior of the outer cylinder 1321. The inner cylinder 1322 includes a plurality of partitions 1322*a* located in the interior of the inner cylinder 1322 and extending the height of the inner cylinder 1322. These partitions 1322*a* form a series of channels 1322*b* extending across the width of the inner cylinder 1322, with gas being capable of flowing through these channels 1322*b*. As shown in FIG. 19A, the partitions 1322*a* are straight walls forming a series of straight channels 1322*b* extending through the inner cylinder 1322. The inner cylinder 1322 is capable of being rotated independent of the outer cylinder 1321 such that the partitions 1322*a* can be oriented at any angle relative to the longitudinal axis of the horizontal segment 103*c*. In FIG. 19A, the inner cylinder 1322 has been rotated so that the partitions 1322*a* are aligned in parallel with the longitudinal axis of the horizontal segment 103*c*. Because the outer cylinder 1321 is rotated such that the openings 1321*a* are upstream and downstream of the inner cylinder 1322, gas can flow into the inner cylinder 1322, through the channels 1322*a* aligned in parallel with the longitudinal axis of the horizontal segment 103*c* and into the common tunnel 102, with the gas entering the common tunnel 102 at an angle approximately orthogonal to the flow of gas through the common tunnel 103.

Figure 19C:
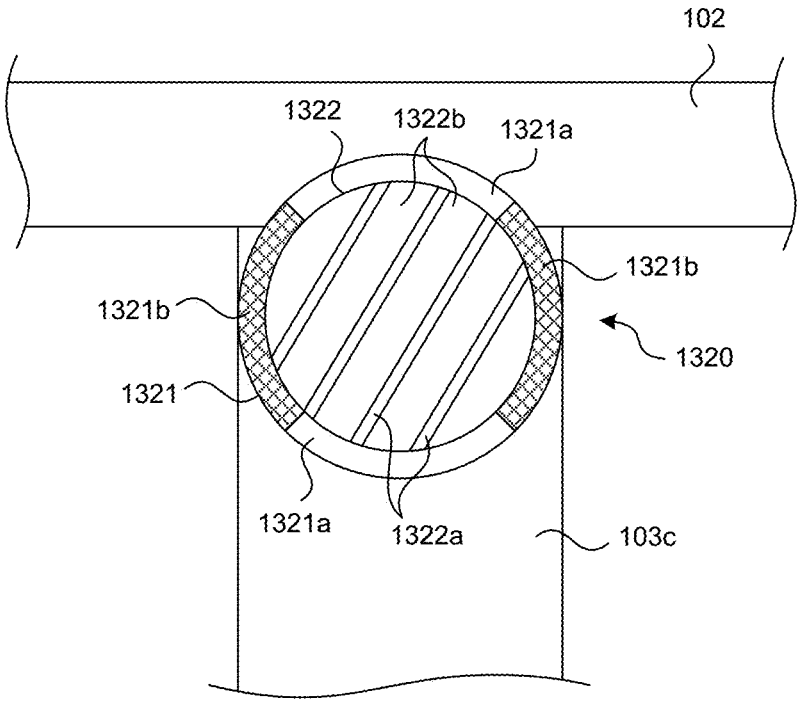

With reference to FIG. 19C, the outer cylinder 1321 can remain in the same position as shown in FIG. 19A, while the inner cylinder 1322 is rotated, e.g., 45 degrees so that the partitions 1322*a* and channels 1322*b* are oriented at a 45 degree angle to the longitudinal axis of the horizontal segment 103*c*. In this configuration, the flow of gas flowing through the uptake damper 1320 will be directed into a common tunnel 102 at an approximately 45 degree angle such that the gas entering the common tunnel 102 from the uptake damper 103 will better integrate with the gas already flowing through the common tunnel 102. The inner cylinder 1322 can be rotated to any position such that gas flowing through the uptake damper 1320 can be redirected and made to enter the common tunnel 102 at practically any desired angle.

Figure 19D:
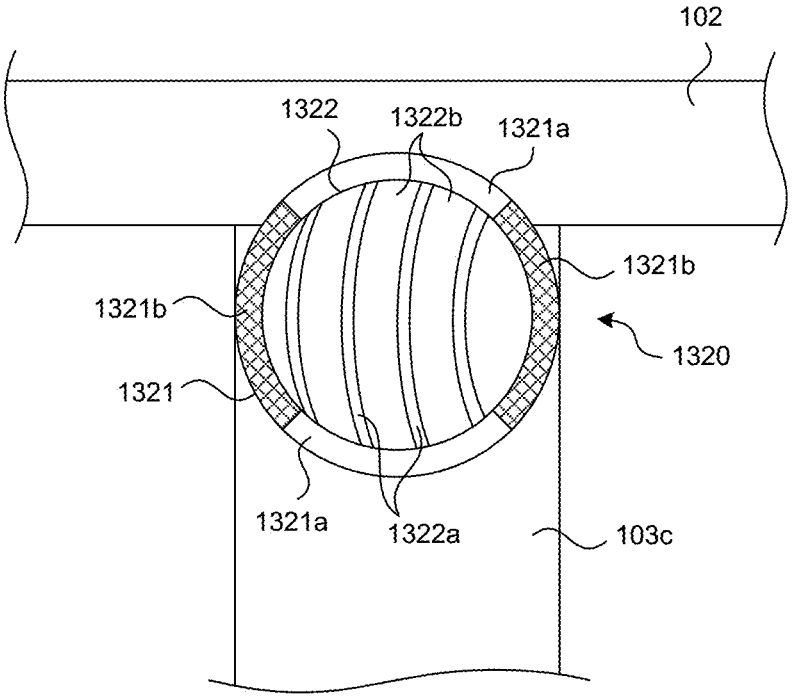

While FIGS. 19A-19C show straight partitions 1322*a* and straight channels 1322*b*, it should be appreciated that the partitions 1322*a* of inner cylinder 1322 can be given any shape to better adjust the angle of gas flowing through the uptake damper 1320. For example, as shown in FIG. 19D, the partitions 1322*a* are curved to thereby form curved channels 1322*b*. In this configuration, the inner cylinder 1322 can still be rotated freely, such that the curved partitions 1322*a* can be set at a more or less severe angle, depending on the desired operating conditions.

As with the cylinder 1221 shown in FIGS. 18A and 18B, the outer cylinder 1321 and the inner cylinder 1322 can be rotated using any suitable means, such as a rod attached to the top of bottom surface of the inner cylinder 1322 and/or the outer cylinder 1321. Such rods preferably do not extend into the interior of the cylinders so as to not obstruct the flow of gas through the cylinders.

While FIGS. 18A-19D illustrate embodiments of a cylindrical-style damper block that is positioned proximate the junction of the horizontal segment 103*c* and the common tunnel 102 for directing exhaust gas entering the common tunnel from the uptake duct 103, it should be appreciated that cylindrical-style damper blocks as shown in FIGS. 18A-19D can be used at any location in a duct system where changing the direction of the exhaust gas is desired. For example, the cylindrical-style damper blocks shown in FIGS. 18A-19D could be used at any other turn in a duct system, including but not limited to, in a bent segment 103*b* between a vertical segment 103*a* and a horizontal segment 103*c* of an uptake duct. Positioning in a cylindrical-style damper block at such a location can assist with directing the exhaust gas through the 90 degree turn between the vertical segment 103*a* and the horizontal segment 103*c*. In such an embodiment, the cylindrical-style damper block may be positioned such that the axis of the cylindrical damper block is horizontal (rather than vertical as shown in FIGS. 18A-19D).

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. An uptake duct configured to receive exhaust gases, comprising:

a channel through which the exhaust gases are configured to pass in a flow direction;

a first refractory surface;

a second refractory surface that opposes the first refractory surface, wherein the first and second refractory surfaces at least partially define the channel;

a damper positioned entirely within the channel, the damper comprising (i) a first layer comprising a first material including steel or fused silica and (ii) a second layer disposed over the first layer and comprising a second material including ceramic and/or fiber, wherein at least one of the first material or the second material is configured to withstand a temperature of at least 2000° F., and wherein the damper is movable between a plurality of orientations to change the flow of exhaust gases through the channel;

a rod coupled to the damper; and an actuator coupled to the rod and configured to move the rod coaxially along an axis from a first orientation within the channel to a second orientation within the channel, wherein the axis is angled relative to the flow direction.

2. The uptake duct of claim 1, wherein the damper is a damper plate having opposing first and second end portions, wherein— the second end portion is spaced apart from the first refractory surface by a first distance when the damper plate is in a first of the plurality of orientations, and the second end portion is spaced apart from the first refractory surface by a second distance less than the first distance when the damper plate is in a second of the plurality of orientations.

3. The uptake duct of claim 2 wherein the damper plate has a plate surface that faces towards the first refractory surface and wherein, when the exhaust gases pass over the plate surface, the plate surface has a substantially uniform temperature.

4. The uptake duct of claim 2 wherein the damper plate forms a first acute angle with the second refractory surface when the damper is in the first orientation and a second acute angle greater than the first acute angle when the damper is in the second orientation.

5. The uptake duct of claim 2, wherein the damper plate comprises a support layer and a facing layer, wherein the facing layer is made from a ceramic or refractory material.

6. An exhaust gas system for a coke oven, comprising:

an uptake duct fluidly coupled to an oven chamber, wherein the uptake duct comprises opposing first and second refractory surfaces defining a channel and is configured to receive a gas flowing in a flow direction;

a damper plate positioned within the uptake duct and having a first end portion and a second end portion;

a rod configured to contact the second end portion of the damper plate; and an actuator coupled to the rod, wherein the first end portion is pivotably coupled to the second refractory surface, the actuator is configured to move the rod along an axis from a first position within the channel to a second position within the channel, wherein the axis is perpendicular to the flow direction, and wherein the rod, when moving along the axis, is perpendicular to the flow direction, in operation, actuating the actuator and moving the rod from the first position toward the second position causes the second end portion of the damper plate to approach the first refractory surface, all of the damper plate is positioned within the uptake duct when the rod is in both the first position and the second position, and the damper plate, when in a fully-closed position, is non-perpendicular to the flow direction.

7. The exhaust system of claim 6, wherein the damper plate has a first plate surface that faces generally toward the first refractory surface and a second plate surface that faces generally toward the second refractory surface.

8. The exhaust gas system of claim 7, wherein the first position comprises a completely-open position and the second position comprises a closed position and wherein the second end portion is positioned adjacent to the first refractory surface when the damper plate is in the closed position and positioned adjacent to the second refractory surface when the damper plate is in the completely-open position.

9. The exhaust system of claim 8, wherein the first plate surface is substantially parallel to the second refractory surface when the damper plate is in the completely-open position.

10. The exhaust gas system of claim 8, wherein the uptake duct includes a cavity formed in the second refractory surface and wherein, when the damper plate is in the completely-open position, the damper plate is received within the cavity.

11. The exhaust gas system of claim 10, wherein, when the damper plate is in the completely-open position and received within the cavity, the first plate surface is coplanar with the second refractory surface and the second plate surface is below the second refractory surface.

12. The exhaust gas system of claim 6, further comprising:

an opening in the uptake duct that extends through a wall of the uptake duct, wherein the rod extends through the opening, such that in the first position a first portion of the rod extends beyond the second refractory surface and in the second position a second portion, greater than the first portion, of the rod extends beyond the second refractory surface.

13. A coke oven, comprising:

an oven chamber;

an uptake duct in fluid communication with the oven chamber, wherein the uptake duct is configured to receive exhaust gases from the oven chamber in a flow direction;

a rod moveable in a coaxial manner along an axis from a first position within the uptake duct to a second position within the uptake duct, wherein the axis is angled relative to the flow direction;

an actuator coupled to the rod; and an uptake damper system configured to control an oven draft, wherein the uptake damper system comprises a damper positioned entirely within the uptake duct, the damper, when in a fully closed position, is non-perpendicular to the flow direction, the damper comprises (i) a first layer comprising a first material including steel or fused silica and (ii) a second layer disposed over the first layer and comprising a second material including fiber, wherein at least one of the first material or the second material is configured to withstand a temperature of at least 2000° F., and the actuator is configured to control the oven draft by moving the damper to a selected one of a plurality of orientations, the damper remaining entirely within the uptake duct in each of the plurality of the orientations.

14. The coke oven of claim 13, wherein the damper is a damper plate comprising opposing first and second end portions, the damper plate is movable between the plurality of orientations by pivoting ab out the first end portion, and the actuator is coupled to the second end portion of the damper plate.

15. The coke oven of claim 14, wherein the actuator is positioned outside of the uptake duct, the uptake duct includes an opening that extends through a refractory surface, and the actuator couples to the second end portion of the damper plate through the opening.

16. The coke oven of claim 15, wherein the refractory surface is formed on a bottom wall of the uptake duct.

17. The coke oven of claim 15, wherein the refractory surface is formed on a sidewall of the uptake duct.

18. The coke oven of claim 13, wherein the uptake damper system is configured to operate at temperatures greater than 500° F.

19. The coke oven of claim 13, wherein the damper includes a first end portion and a second end portion spaced apart from the first end portion, wherein the first end portion is pivotably coupled to the second refractory surface, the axis is perpendicular to the flow direction, the rod, when moving along the axis, is perpendicular to the flow direction, and in operation, actuating the actuator and moving the rod to the second position causes the second end portion of the damper to approach the first refractory surface.

* * * * *